US011132973B2

(12) United States Patent
Tyler

(10) Patent No.: US 11,132,973 B2
(45) Date of Patent: Sep. 28, 2021

(54) SYSTEM FOR CAPTURING IMAGES FROM APPLICATIONS RENDERING VIDEO TO A NATIVE PLATFORM WITH A GRAPHICS RENDERING LIBRARY

(71) Applicant: Forcepoint, LLC, Austin, TX (US)

(72) Inventor: Benjamin Tyler, Holladay, UT (US)

(73) Assignee: Forcepoint, LLC, Austin, TX (US)

( * ) Notice: Subject to any disclaimer, the term of this patent is extended or adjusted under 35 U.S.C. 154(b) by 0 days.

(21) Appl. No.: 16/265,015

(22) Filed: Feb. 1, 2019

(65) Prior Publication Data

US 2020/0251067 A1 Aug. 6, 2020

(51) Int. Cl.
*G09G 5/00* (2006.01)
*G09G 5/39* (2006.01)

(52) U.S. Cl.
CPC ..... *G09G 5/006* (2013.01); *G09G 5/39* (2013.01); *G09G 2358/00* (2013.01); *G09G 2360/18* (2013.01)

(58) Field of Classification Search
CPC ..... G09G 5/006; G09G 5/39; G09G 2358/00
See application file for complete search history.

(56) References Cited

U.S. PATENT DOCUMENTS 7,249,369 B2 7/2007 Knouse et al.
7,558,775 B1 7/2009 Panigrahy et al.
7,916,702 B2 3/2011 Hirano et al.
7,941,484 B2 5/2011 Chandler et al.
7,965,830 B2 6/2011 Fleck et al.
8,060,904 B1 11/2011 Evans et al.
8,341,734 B1 12/2012 Hernacki et al.
8,347,392 B2 1/2013 Chess et al.
8,432,914 B2 4/2013 Zinjuwadia et al.
8,463,612 B1 * 6/2013 Neath ..... H04L 65/1083 370/352
8,695,090 B2 4/2014 Barile et al.
8,856,869 B1 10/2014 Brinskelle
9,146,953 B1 9/2015 Hernacki et al.
9,183,258 B1 11/2015 Taylor et al.
(Continued)

OTHER PUBLICATIONS github.com, Gnome Mutter desktop manager, https://github.com/GNOME/mutter, downloaded Feb. 1, 2019.
(Continued)

*Primary Examiner* — Sarah Lhymn
(74) *Attorney, Agent, or Firm* — Terrile, Cannatti & Chambers; Stephen A. Terrile

(57) ABSTRACT

A method, system and computer-usable medium are disclosed for capturing an image rendered by a target application. One general aspect includes a computer-implemented method for capturing an image, the method including: intercepting API calls made by a target application to a graphics display driver, where the API calls made to the graphics display driver by the target application are made using a graphics rendering API library; and using the intercepted API calls to construct a copy of a frame buffer of the image, where the copy of the frame buffer is constructed independent of the graphics display driver. Certain embodiments may include corresponding stand-alone and/or network computer systems, apparatus, and computer programs recorded on one or more computer storage devices, each configured to perform one or more of these actions.

20 Claims, 10 Drawing Sheets

(56) References Cited

U.S. PATENT DOCUMENTS 9,197,601 B2 11/2015 Pasdar
9,208,316 B1 12/2015 Hill et al.
9,208,450 B1 12/2015 Nanda et al.
9,219,752 B2 12/2015 Balinsky et al.
9,363,164 B2 6/2016 Lemieux
9,367,872 B1 6/2016 Visbal et al.
9,374,228 B2 6/2016 Pendarakis et al.
9,380,523 B1 6/2016 Mijar et al.
9,419,855 B2 8/2016 Ganichev et al.
9,465,668 B1 10/2016 Roskind et al.
9,491,183 B1 11/2016 Dippenaar
9,525,838 B2 12/2016 Thiyagarajan
9,826,023 B2 11/2017 Yu
9,847,910 B2 12/2017 Chung
10,057,157 B2 8/2018 Goliya et al.
10,063,419 B2 8/2018 Horstmann et al.
10,122,632 B2 11/2018 Trossen et al.
10,142,353 B2 11/2018 Yadav et al.
10,142,427 B2 11/2018 Li et al.
10,176,341 B2 1/2019 Spaulding et al.
10,187,485 B1 1/2019 Shavell et al.
10,192,074 B2 1/2019 Sarin et al.
10,205,663 B1 2/2019 Jones et al.
10,237,175 B2 3/2019 Pignataro et al.
10,255,445 B1 4/2019 Brinskelle
10,270,878 B1 4/2019 Uppal et al.
10,284,578 B2 5/2019 Brugger et al.
10,284,595 B2 5/2019 Reddy et al.
10,289,857 B1 5/2019 Brinskelle
10,291,417 B2 5/2019 Vucina et al.
10,296,558 B1 5/2019 McInerny
10,305,776 B2 5/2019 Horn et al.
10,326,735 B2 6/2019 Jakobsson et al.
10,331,769 B1 6/2019 Hill et al.
10,348,639 B2 7/2019 Puchala et al.
10,349,304 B2 7/2019 Kim et al.
10,355,973 B2 7/2019 Cicic et al.
10,439,926 B2 10/2019 Horn et al.
10,440,503 B2 10/2019 Tapia
10,498,693 B1 12/2019 Strauss et al.
10,530,697 B2 1/2020 Fourie et al.
10,599,462 B2 3/2020 Fried-Gintis
10,601,787 B2 3/2020 Pritikin et al.
10,635,512 B2 4/2020 Pepin et al.
10,652,047 B2 5/2020 Jain et al.
10,708,125 B1 7/2020 Chen
2002/0120599 A1 8/2002 Knouse et al.
2003/0169724 A1 9/2003 Mehta et al.
2004/0146006 A1 7/2004 Jackson
2005/0027782 A1 2/2005 Jalan et al.
2005/0102266 A1* 5/2005 Nason ..... G06F 21/82
2005/0105608 A1 5/2005 Coleman et al.
2005/0207405 A1* 9/2005 Dowling ..... H04M 3/5191 370/352
2005/0273850 A1 12/2005 Freund
2006/0018466 A1 1/2006 Adelstein et al.
2006/0221967 A1 10/2006 Narayan et al.
2008/0320556 A1 12/2008 Lee et al.
2009/0175211 A1 7/2009 Jakobsen
2009/0241197 A1 9/2009 Troyansky
2009/0296685 A1* 12/2009 O'Shea ..... H04L 69/32 370/351
2009/0307600 A1 12/2009 Arthur et al.
2011/0169844 A1* 7/2011 Diard ..... G06F 9/451 345/522
2012/0324365 A1 12/2012 Momchilov et al.
2013/0034097 A1 2/2013 Dharmapurikar et al.
2013/0091214 A1 4/2013 Kellerman et al.
2013/0120411 A1* 5/2013 Swift ..... G06T 15/005 345/505
2013/0340029 A1 12/2013 De Armas et al.
2014/0032759 A1* 1/2014 Barton ..... H04L 67/10 709/225
2014/0082726 A1 3/2014 Dreller et al.
2014/0109174 A1 4/2014 Barton et al.
2014/0146062 A1* 5/2014 Kiel ..... G06F 11/3664 345/522
2014/0165137 A1 6/2014 Balinsky et al.
2014/0207850 A1 7/2014 Bestler et al.
2014/0237594 A1* 8/2014 Thakadu ..... G06F 21/52 726/23
2014/0280517 A1 9/2014 White et al.
2014/0379812 A1 12/2014 Bastide, II et al.
2015/0067832 A1 3/2015 Sastry
2015/0134730 A1 5/2015 Seedorf et al.
2015/0220707 A1* 8/2015 Kline ..... G06F 21/10 726/30
2015/0264035 A1 9/2015 Waterhouse et al.
2015/0264049 A1 9/2015 Achilles et al.
2015/0288714 A1 10/2015 Emigh et al.
2015/0381641 A1 12/2015 Cabrera et al.
2016/0080397 A1 3/2016 Bacastow et al.
2016/0094645 A1 3/2016 Ashutosh et al.
2016/0103992 A1 4/2016 Roundy et al.
2016/0212012 A1 7/2016 Young et al.
2016/0352719 A1 12/2016 Yu
2016/0378409 A1 12/2016 Muramatsu
2017/0061345 A1 3/2017 Jones, III et al.
2017/0126587 A1 5/2017 Ranns et al.
2017/0126718 A1 5/2017 Baradaran et al.
2017/0134506 A1 5/2017 Rotem et al.
2017/0237779 A1 8/2017 Seetharaman et al.
2017/0264628 A1 9/2017 Treat et al.
2017/0302665 A1 10/2017 Zou et al.
2018/0012144 A1 1/2018 Ding et al.
2018/0115613 A1* 4/2018 Vajravel ..... H04L 67/141
2018/0152471 A1 5/2018 Jakobsson
2018/0165463 A1 6/2018 McCreary et al.
2018/0173453 A1 6/2018 Danilov et al.
2018/0234368 A1 8/2018 Everton
2018/0330257 A1 11/2018 Dodson et al.
2018/0375760 A1 12/2018 Saavedra
2019/0037029 A1 1/2019 Border
2019/0057200 A1 2/2019 Sabag et al.
2019/0075124 A1 3/2019 Kimhi et al.
2019/0182213 A1 6/2019 Saavedra et al.
2019/0199745 A1 6/2019 Jakobsson et al.
2019/0230090 A1 7/2019 Kathiara et al.
2019/0268381 A1 8/2019 Narayanaswamy et al.
2019/0278760 A1 9/2019 Smart
2019/0342313 A1* 11/2019 Watkiss ..... H04L 63/1416
2019/0354709 A1 11/2019 Brinskelle
2019/0378102 A1 12/2019 Kohli
2020/0007548 A1 1/2020 Sanghavi et al.
2020/0021515 A1 1/2020 Michael et al.
2020/0021684 A1 1/2020 Kreet et al.
2020/0153719 A1 5/2020 Chauhan
2020/0196092 A1 6/2020 Jones
2020/0213336 A1 7/2020 Yu et al.
2020/0314002 A1 10/2020 Benoist et al.
2020/0314004 A1 10/2020 Rashad et al.

OTHER PUBLICATIONS github.com, SimpleScreenRecorder, https://github.com/MaartenBaert/ssr, downloaded Feb. 1, 2019.

Papadopoulos et al., An error control scheme for large-scale multicast applications, Proceedings, IEEE INFOCOM '98, the Conference on Computer Communications; Mar. 29-Apr. 2, 1998.

Schmidt et al., AuthoCast: a protocol for mobile multicast sender authentication, Proceeding, MoMM '08 Proceedings of the 6th International Conference on Advanced in Mobile Computing and Multimedia, pp. 142-149, 2008.

Baker F., "Requirements for IP Version 4 Routers," RFC 1812, Jun. 1995. (Year: 1995).

Nichols et al., "Definition of the Differentiated Services Field (DS field) in the IPv4 and IPv6 Headers," RFC 2474, Dec. 1998. (Year: 1998).

Fuller et al., "Classless Inter-Domain Routing (CIDR): The Internet Address Assignment and Aggregation Plan," RFC 4632, Aug. 2006. (Year: 2006).

(56) References Cited

OTHER PUBLICATIONS

Hinden, R., "Applicability Statement for the Implementation of Classless Inter-Domain Routing (CIDR)," RFC 1517, Internet Engineering Steering Group, Sep. 1993. (Year: 1993).
Grossman, D., "New Terminology and Clarifications for Diffserv," RFC 3260, Apr. 2002. (Year: 2002).
Arkko J. et al., "IPv4 Address Blocks Reserved for Documentation," RFC 5737, Jan. 2010. (Year: 2010).
Cotton, M. et al., "Special Purpose IP Address Registries," RFC 6890, Apr. 2013. (Year: 2013).
Housley, R. et al., "The Internet Numbers Registry System," RFC 7020, Aug. 2013. (Year: 2013).
mybluelinux.com, What is email envelope and email header, downloaded Jan. 16, 2020.
Check Point Software Technologies Ltd., Firewall and SmartDefense, Version NGX R62, 702048, Sep. 25, 2006.
Check Point Software Technologies Ltd., Softwareblades, Firewall R75.40, Administration Guide, Nov. 30, 2014.
Fortinet, FortiOS Handbook—Firewall, version 5.2.0, May 5, 2017.
Wikipedia, IP Address Spoofing, printed Aug. 16, 2017.
David Davis, Techrepublic, Prevent IP Spoofing with the Cisco IOS, Mar. 14, 2007.
evostream.com, Media Server and Video Streaming Software, https://evostream.com/#, printed Feb. 22, 2018.
wowza.com, Wowza Streaming Engine, https://www.wowza.com/products/streaming-engine, printed Feb. 22, 2018.
opencv.org, https://opencv.org/, printed Mar. 6, 2018.
stackoverflow.com, OpenCV Crop Live Feed from Camera, https://stackoverflow.com/questions/17352420/opencv-crop-live-feed-from-camera, printed Feb. 22, 2018.
Zscaler, About Virtual ZENs, downloaded Apr. 4, 2019.
Splunk, Adaptive Operations Framework, printed Jan. 29, 2020 https://www.splunk.com/en_us/solutions/solution-areas/security-and-fraud/adaptive-response-initiative.html.
Gugelmann, David et al. "Can content-based data loss prevention solutions prevent data leakage in Web traffic?" IEEE Security & Privacy 13.4 (2015): 52-59, (Year: 2015).
Yoshihama, Sachiko et al., "Web-Based Data Leakage Prevention," IWSEC (Short Papers), 2010 (Year: 2010).

* cited by examiner

SYSTEM FOR CAPTURING IMAGES FROM APPLICATIONS RENDERING VIDEO TO A NATIVE PLATFORM WITH A GRAPHICS RENDERING LIBRARY

BACKGROUND OF THE INVENTION

Field of the Invention

The present invention relates in general to the field of computers and similar technologies, and in particular to hardware and software utilized in this field. Still more particularly, it relates to a method, system and computer-usable medium for collecting images from an application, wherein the application is configured to render video to a native platform using a graphics rendering API library.

Description of the Related Art

Users interact with physical, system, data, and services resources of all kinds, as well as each other, on a daily basis. Each of these interactions, whether accidental or intended, poses some degree of security risk, depending on the behavior of the user. In particular, the actions of a formerly trusted user may become malicious as a result of being subverted, compromised or radicalized due to any number of internal or external factors or stressors. For example, financial pressure, political idealism, irrational thoughts, or other influences may adversely affect a user's intent and/or behavior. Computerized security systems are tasked with detecting actual and potential security breaches by such users.

SUMMARY OF THE INVENTION

A method, system and computer-usable medium are disclosed for capturing an image rendered by a target application. The present invention may be implemented by a system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a computer-implemented method for capturing an image, the method including: intercepting API calls made by a target application to a graphics display driver, where the API calls made to the graphics display driver by the target application are made using a graphics rendering API library; and using the intercepted API calls to construct a copy of a frame buffer of the image, where the copy of the frame buffer is constructed independent of the graphics display driver. Other embodiments of this aspect include corresponding computer systems, apparatus, and computer programs recorded on one or more computer storage devices, each configured to perform one or more the actions of the methods.

Another general aspect includes a system including: a processor; a data bus coupled to the processor; and a non-transitory, computer-readable storage medium embodying computer program code, the non-transitory, computer-readable storage medium being coupled to the data bus, the computer program code interacting with a plurality of computer operations and including instructions executable by the processor and configured for: intercepting API calls made by a target application to a graphics display driver, where the API calls made to the graphics display driver by the target application are made using a graphics rendering API library; and using the intercepted API calls to construct a copy of a frame buffer of an image, where the copy of the frame buffer is constructed independent of the graphics display driver. Other embodiments of this aspect include corresponding computer systems, apparatus, and computer programs recorded on one or more computer storage devices, each configured to perform one or more of the actions of the system.

Another general aspect includes a non-transitory, computer-readable storage medium embodying computer program code, the computer program code including computer executable instructions configured for: intercepting API calls made by a target application to a graphics display driver, where the API calls made to the graphics display driver by the target application are made using a graphics rendering API library; and using the intercepted API calls to construct a copy of a frame buffer of an image, where the copy of the frame buffer is constructed independent of the graphics display driver. Other embodiments of this aspect include corresponding computer systems, apparatus, and computer programs recorded on one or more computer storage devices, each configured to perform one or more of the actions of the methods embodied on the non-transitory, computer-readable storage medium.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
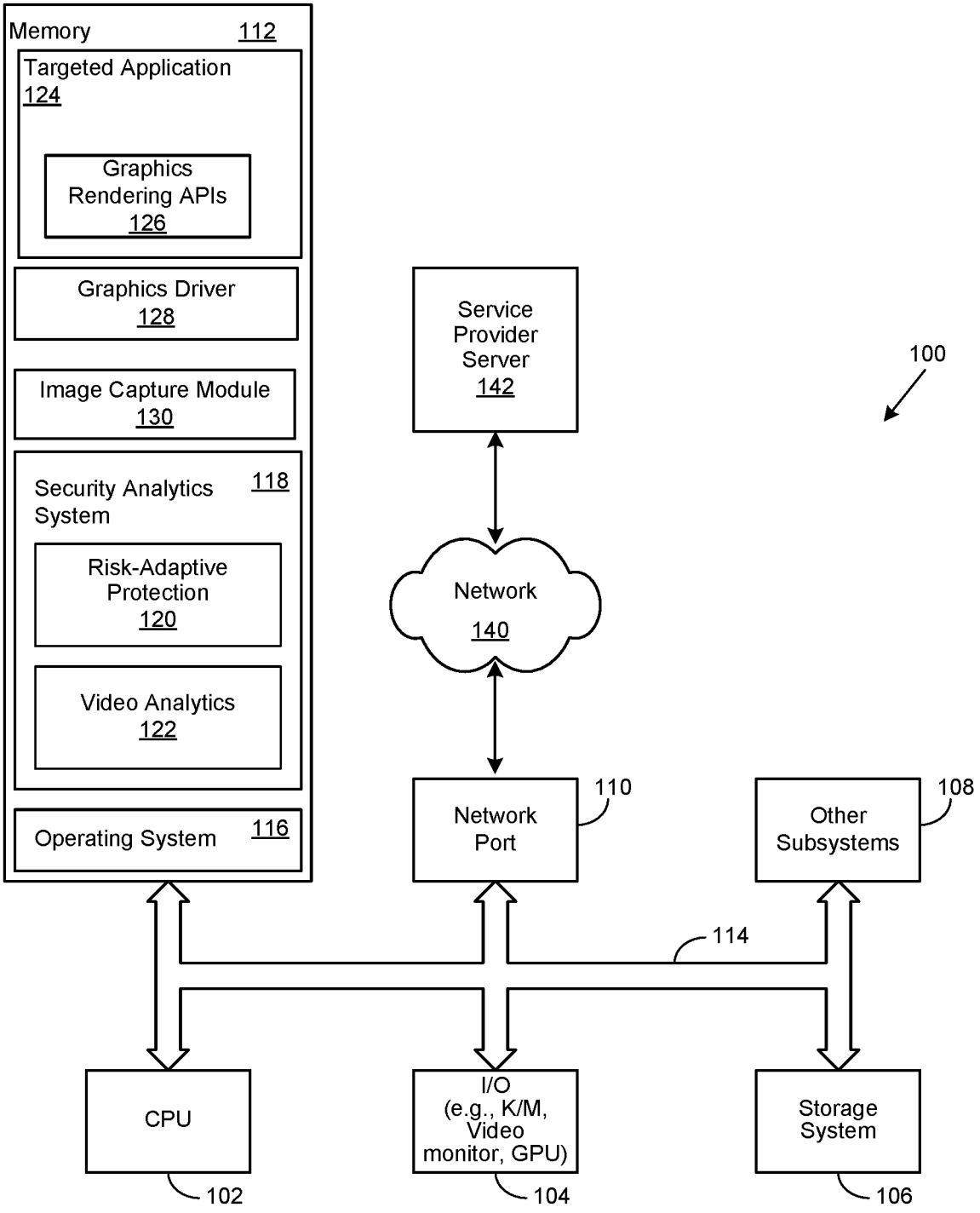
FIG. 1 depicts an exemplary computer system employing one embodiment of an image capture system.

A method, system and computer-usable medium are disclosed for capturing images from a targeted application in which the targeted application renders video to a native platform with a graphics rendering API library. Certain embodiments of the disclosed system are capture images from targeted applications that render graphics with an EGL API library. However, it will be recognized in view of the teachings of the present disclosure, that the disclosed system may be used with various graphics rendering API libraries.

Certain aspects of the invention recognize that captured images may be used in a variety of systems, including, for example, computer security systems. Certain aspects of the invention recognize existing image capture techniques are difficult to implement in a security system in a manner that is flexible and transparent to the user. As an example, many existing solutions for screen grabbing/screen casting are either built into a windows manager implementation, as with the Gnome "Mutter" Desktop Manager, or loaded with the targeted application at runtime via, for example, the LD_PRELOAD Linux Linker technique. Certain aspects of the present invention recognize that these existing solutions cannot be applied to an application that was launched without a preload library. Additionally, certain aspects of the present invention recognize that it may not be desirable to tie an image capture solution to a specific window manager implementation.

Certain embodiments of the present invention are disclosed in the context of an information handling system. For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a mobile device such as a tablet or smartphone, a consumer electronic device, a connected "smart device," a network appliance, a network storage device, a network gateway device, a server or collection of servers or any other suitable device and may vary in size, shape, performance, functionality, and price. The information handling system may include volatile and/or non-volatile memory, and one or more processing resources such as a central processing unit (CPU) or hardware or software control logic. Additional components of the information handling system may include one or more storage systems, one or more wired or wireless interfaces for communicating with other networked devices, external devices, and various input and output (I/O) devices, such as a keyboard, a mouse, a microphone, speakers, a track pad, a touchscreen and a display device (including a touch sensitive display device). The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or solid state drive), a sequential access storage device (e.g., a tape disk drive), optical storage device, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

FIG. 1 is a generalized illustration of an information handling system 100 that can be used to implement the system and method of the present invention. The information handling system 100 includes a processor (e.g., central processor unit or "CPU") 102, input/output (I/O) devices 104, such as a display, a keyboard, a mouse, and associated controllers (e.g., a graphics processing unit (GPU), a storage system 106, and various other subsystems 108. In various embodiments, the information handling system 100 also includes network port 110 operable to connect to a network 140, which is likewise accessible by a service provider server 142. The information handling system 100 likewise includes system memory 112, which is interconnected to the foregoing via one or more buses 114. System memory 112 further includes operating system (OS) 116 and in various embodiments may also include a security analytics system 118. In one embodiment, the information handling system 100 is able to download the security analytics system 118 from the service provider server 142. In another embodiment, the security analytics system 118 is provided as a service from the service provider server 142.

In various embodiments, the security analytics system 118 performs a security analytics operation. In certain embodiments, the security analytics operation improves processor efficiency, and thus the efficiency of the information handling system 100, by facilitating security analytics functions. As will be appreciated, once the information handling system 100 is configured to perform the security analytics operation, the information handling system 100 becomes a specialized computing device specifically configured to perform the security analytics operation and is not a general purpose computing device. Moreover, the implementation of the security analytics system 118 on the information handling system 100 improves the functionality of the information handling system 100 and provides a useful and concrete result of capturing images in a flexible and robust manner pursuant to performing security analytics functions. In certain embodiments, the security analytics system 118 may include a risk-adaptive protection 120 module and a video analytics module 122. In certain embodiments, the security analytics system 118 may be implemented to detect potential security breaches and/or risky user activity using image information analyzed by the video analytics module 122. In certain embodiments, the risk-adaptive protection module 120 and the video analytics module 122 may be implemented to detect an image of information displayed by a targeted application 124 and adaptively respond to or otherwise execute risk mitigation operations.

In various embodiments, the memory 112 includes a targeted application 124, with which a user interacts to execute one or more computer operations. As an example, such targeted applications may include a word processing application, a spreadsheet application, an image editing application, a web browser application, an image acquisition application, etc. As a further example, such targeted applications may also include a desktop environment applications. As used herein, a desktop environment is an implementation of the desktop metaphor made of a bundle of desktop environment applications running on top of a computer operating system, which share a common graphical user interface, sometimes described as a graphical shell. Certain embodiments of the targeted applications 124 render video to a GPU in I/O 104 by making API calls to a graphics driver 128 with graphics rendering APIs 126 of a graphics rendering library.

In the example shown in FIG. 1, the memory 112 also includes an image capture module 130. In certain embodiments, the image capture module 130 is used to capture an image rendered by the target application 124. To this end, certain embodiments of the image capture module 130 intercept graphics rendering API calls made to the graphics driver 128 by the target application 124. In certain embodiments, the intercepted API calls are used by the image capture module 130 to construct a copy of a frame buffer. In certain embodiments, the copy of the frame buffer is constructed independent of the graphics driver. In certain embodiments, a copy of a frame buffer is stored periodically and/or in response to certain graphics rendering events. In certain embodiments, copies of the frame buffer are stored for analysis by, for example, the video analytics module 122. In certain embodiments, the video analytics module 122 may merely present copies of the frame buffer as video to a security administrator for human analysis. In certain embodiments, the video analytics module may be used to automatically detect images that represent suspicious activity engaged in by a user. In certain embodiments, the video analytics module 122 may be used to detect visual hacking. It will be recognized in view of the teachings of present disclosure that various other types of security assessments of the captured images may be conducted.

Figure 2:
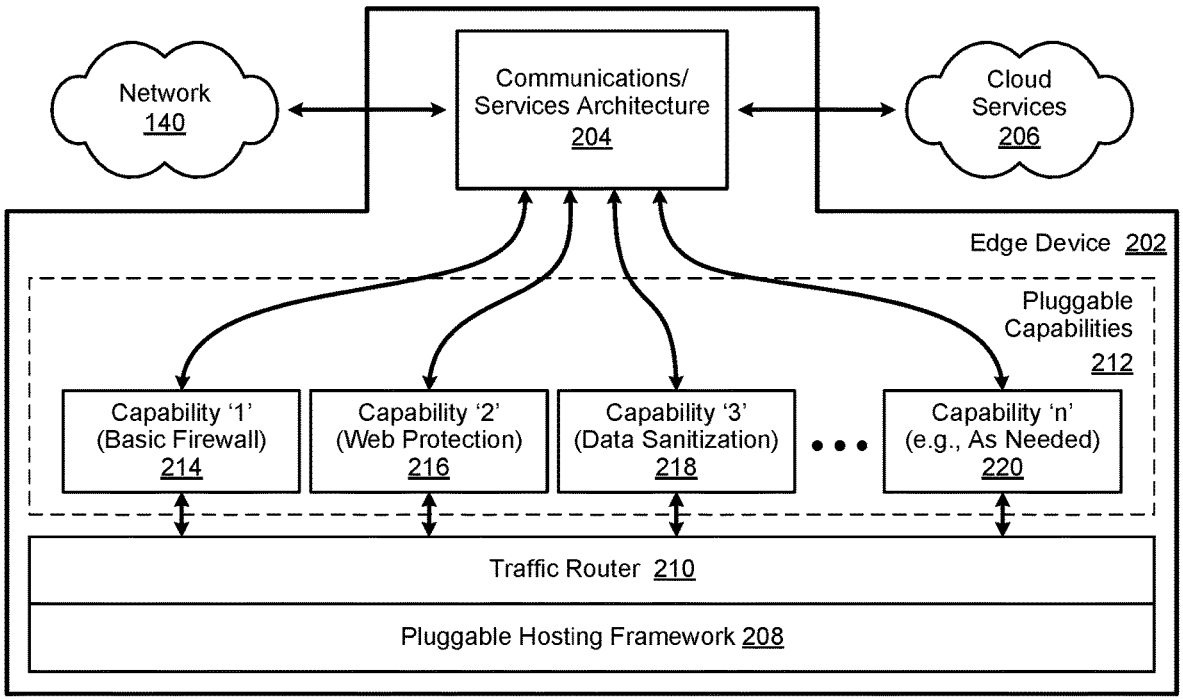
FIG. 2 is a simplified block diagram of an edge device.

FIG. 2 is a simplified block diagram of an edge device implemented in accordance with an embodiment of the invention. As used herein, an edge device, such as the edge device 202 shown in FIG. 2, broadly refers to a device providing an entry point into a network 140. Examples of such edge devices 202 may include routers, routing switches, integrated access devices (IADs), multiplexers, wide-area network (WAN) access devices, and network security appliances. In certain embodiments, the network 140 may be a private network (e.g., an enterprise network), a semi-public network (e.g., a service provider core network), or a public network (e.g., the Internet).

Skilled practitioners of the art will be aware that edge devices 202 are often implemented as routers that provide authenticated access to faster, more efficient backbone and core networks. Furthermore, current industry trends include making edge devices 202 more intelligent, which allows core devices to operate at higher speed as they are not burdened with additional administrative overhead. Accordingly, such edge devices 202 often include Quality of Service (QoS) and multi-service functions to manage different types of traffic. Consequently, it is common to design core networks with switches that use routing protocols such as Open Shortest Path First (OSPF) or Multiprotocol Label Switching (MPLS) for reliability and scalability. Such approaches allow edge devices 202 to have redundant links to the core network, which not only provides improved reliability, but enables enhanced, flexible, and scalable security capabilities as well.

In certain embodiments, the edge device 202 may be implemented to include a communications/services architecture 204, various pluggable capabilities 212, a traffic router 210, and a pluggable hosting framework 208. In certain embodiments, the communications/services architecture 202 may be implemented to provide access to and from various networks 140, cloud services 206, or a combination thereof. In certain embodiments, the cloud services 206 may be provided by a cloud infrastructure familiar to those of skill in the art. In certain embodiments, the edge device 202 may be implemented to provide support for a variety of generic services, such as directory integration, logging interfaces, update services, and bidirectional risk/context flows associated with various analytics. In certain embodiments, the edge device 202 may be implemented to provide temporal information associated with the provision of such services.

In certain embodiments, the edge device 202 may be implemented as a generic device configured to host various network communications, data processing, and security management capabilities. In certain embodiments, the pluggable hosting framework 208 may be implemented to host such capabilities in the form of pluggable capabilities 212. In certain embodiments, the pluggable capabilities 212 may include capability '1' 214 (e.g., basic firewall), capability '2' 216 (e.g., general web protection), capability '3' 218 (e.g., data sanitization), and so forth through capability 'n' 220, which may include capabilities needed for a particular operation, process, or requirement on an as-needed basis. In certain embodiments, such capabilities may include the performance of operations associated with managing the use of a blockchain to access a cyberprofile, or other sensitive private information (SPI). In certain embodiments, such operations may include the provision of associated temporal information (e.g., time stamps).

In certain embodiments, the pluggable capabilities 212 may be sourced from various cloud services 206. In certain embodiments, the pluggable hosting framework 208 may be implemented to provide certain computing and communication infrastructure components, and foundation capabilities, required by one or more of the pluggable capabilities 212. In certain embodiments, the pluggable hosting framework 208 may be implemented to allow the pluggable capabilities 212 to be dynamically invoked. Skilled practitioners of the art will recognize that many such embodiments are possible. Accordingly, the foregoing is not intended to limit the spirit, scope or intent of the invention.

Figure 3:
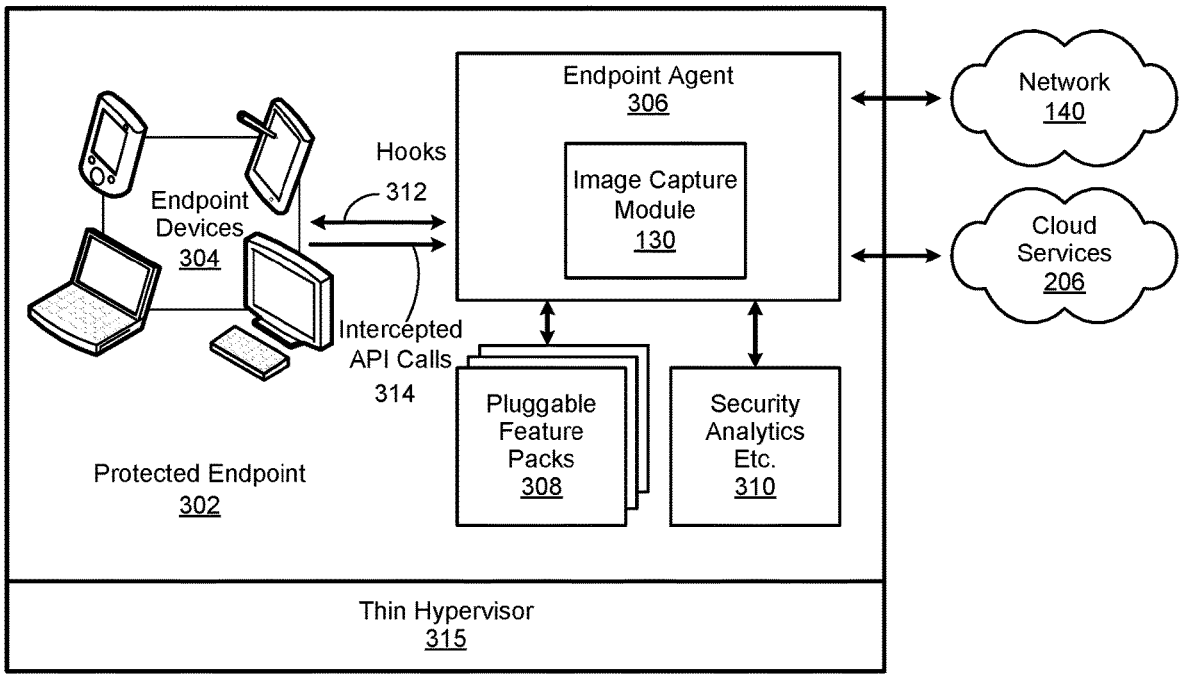
FIG. 3 is a simplified block diagram of an endpoint agent.

FIG. 3 is a simplified block diagram of an endpoint agent in which certain embodiments of the disclosed invention may operate. As used herein, an endpoint agent 306 broadly refers to a software agent used in combination with an endpoint device 304 to establish a protected endpoint 302. Skilled practitioners of the art will be familiar with software agents, which are computer programs that perform actions on behalf of a user or another program. In various approaches, a software agent may be autonomous or work together with another agent or a user. In certain of these approaches the software agent is implemented to autonomously decide if a particular action is appropriate for a given event, such as an observed user behavior.

An endpoint device 304, as likewise used herein, refers to an information handling system such as a personal computer, a laptop computer, a tablet computer, a personal digital assistant (PDA), a smart phone, a mobile telephone, a digital camera, a video camera, or other device that is capable of storing, processing and communicating data. In certain embodiments, the communication of the data may take place in real-time or near-real-time. As used herein, real-time broadly refers to processing and providing information within a time interval brief enough to not be discernable by a user. As an example, a cellular phone conversation may be used to communicate information in real-time, while an instant message (IM) exchange may be used to communicate information in near real-time. In certain embodiments, the communication of the information may take place asynchronously. For example, an email message may be stored on an endpoint device 304 when it is offline. In this example, the information may be communicated to its intended recipient once the endpoint device 304 gains access to a network 140.

A protected endpoint 302, as likewise used herein, broadly refers to a policy-based approach to network security that typically requires endpoint devices 304 to comply with particular criteria before they are granted access to network resources. As an example, a given endpoint device 304 may be required to have a particular operating system (OS), or version thereof, a Virtual Private Network (VPN) client, anti-virus software with current updates, and so forth. In certain embodiments, the protected endpoint 302 may be implemented to perform operations associated with providing real-time resolution of the identity of an entity at a particular point in time, as described in greater detail herein. In certain embodiments, the protected endpoint 302 may be implemented to provide temporal information, such as time-stamp information, associated with such operations.

In certain embodiments, the real-time resolution of the identity of an entity at a particular point in time may be based upon contextual information associated with a given user behavior. As used herein, contextual information broadly refers to any information, directly or indirectly, individually or in combination, related to a particular user behavior. In certain embodiments, user behavior may include a user's physical behavior, cyber behavior, or a combination thereof. As likewise used herein, physical behavior broadly refers to any user behavior occurring within a physical realm. More particularly, physical behavior may include any action enacted by a user that can be objectively observed, or indirectly inferred, within a physical realm.

As an example, a user may attempt to use an electronic access card to enter a secured building at a certain time. In this example, the use of the access card to enter the building is the action and the reading of the access card makes the user's physical behavior electronically-observable. As another example, a first user may physically transfer a document to a second user, which is captured by in frame buffers of a video surveillance system. In this example, the physical transferal of the document from the first user to the second user is the action. Likewise, the video record of the transferal makes the first and second user's physical behavior electronically-observable. As used herein, electronically-observable user behavior broadly refers to any behavior exhibited or enacted by a user that can be electronically observed.

Cyber behavior, as used herein, broadly refers to any behavior occurring in cyberspace, whether enacted by an individual user, a group of users, or a system acting at the behest of an individual user, a group of users, or an entity. More particularly, cyber behavior may include physical, social, or mental actions that can be objectively observed, or indirectly inferred, within cyberspace. As an example, a user may use an endpoint device 304 to access and browse a particular website on the Internet. In this example, the individual actions performed by the user to access and browse the website constitute a cyber behavior. As another example, a user may use an endpoint device 304 to download a data file from a particular system at a particular point in time. In this example, the individual actions performed by the user to download the data file, and associated temporal information, such as a time-stamp associated with the download, constitute a cyber behavior. In these examples, the actions are enacted within cyberspace, in combination with associated temporal information, makes them electronically-observable.

As likewise used herein, cyberspace broadly refers to a network 140 environment capable of supporting communication between two or more entities. In certain embodiments, the entity may be a user, an endpoint device 304, or various resources, described in greater detail herein. In certain embodiments, the entities may include various endpoint devices 304 or resources operating at the behest of an entity, such as a user. In certain embodiments, the communication between the entities may include audio, image, video, text, or binary data.

As described in greater detail herein, the contextual information may include a user's authentication factors. Contextual information may likewise include various temporal identity resolution factors, such as identification factors associated with the user, the date/time/frequency of various user behaviors, the user's location, the user's role or position in an organization, their associated access rights, and certain user gestures employed by the user in the enactment of a user behavior. Other contextual information may likewise include various user interactions, whether the interactions are with an endpoint device 304, a network 140, a resource, or another user. In certain embodiments, user behaviors, and their related contextual information, may be collected at particular points of observation, and at particular points in time, described in greater detail herein.

In certain embodiments, the endpoint agent 306 may be implemented to universally support a variety of operating systems, such as Apple Macintosh®, Microsoft Windows®, Linux®, Android® and so forth. In certain embodiments, the endpoint agent 306 may include an image capture module 130. In certain embodiments, the image capture module may be implemented to interact with targeted applications executed by the endpoint device 304 through the use of hooks 312, such as API hooks. In certain embodiments, the software hooks are inserted at load time of a targeted application so that the hooks 312 and target application are loaded in a generally concurrent manner. In certain embodiments, the hooks 312 are loaded during runtime of the target application after the target application has been loaded. Certain embodiments of the image capture module 130 intercept API calls 314 made by the target applications to copy frame buffers rendered by the targeted applications. In certain embodiments, the copied frame buffers may be provided as an event stream that may be analyzed locally. Additionally, or in the alternative, certain embodiments may provide the copied frame buffers in an event stream that is transmitted to network 140. It will be appreciated that the use of hooks 312 may also allow the endpoint agent 306 to subscribe to other events occurring at the endpoint devices, such as email events, file transfer events, etc. In certain embodiments, multiple functionalities provided by the endpoint agent 306 can share a single data stream, using only those portions of the data stream they may individually need. Accordingly, system efficiency can be improved and operational overhead reduced.

In certain embodiments, the endpoint agent 306 may be implemented to provide a common infrastructure for pluggable feature packs 308. In various embodiments, the pluggable feature packs 308 may provide certain security management functionalities. Examples of such functionalities may include various anti-virus and malware detection, data loss protection (DLP), insider threat detection, and so forth. In certain embodiments, the security management functionalities may include one or more functionalities associated with providing real-time resolution of the identity of an entity at a particular point in time.

In certain embodiments, a particular pluggable feature pack 308 is invoked as needed by the endpoint agent 306 to provide a given functionality. In certain embodiments, individual features of a particular pluggable feature pack 308 are invoked as needed. It will be appreciated that the ability to invoke individual features of a pluggable feature pack 308, without necessarily invoking all such features, will likely improve the operational efficiency of the endpoint agent 306 while simultaneously reducing operational overhead. Accordingly, the endpoint agent 306 can self-optimize in certain embodiments by using the common infrastructure and invoking only those pluggable components that are applicable or needed for a given user behavior.

In certain embodiments, the individual features of a pluggable feature pack 308 are invoked by the endpoint agent 306 according to the occurrence of a particular user behavior. In certain embodiments, the individual features of a pluggable feature pack 308 are invoked by the endpoint agent 306 according to the occurrence of a particular temporal event, described in greater detail herein. In certain embodiments, the individual features of a pluggable feature pack 308 are invoked by the endpoint agent 306 at a particular point in time. In these embodiments, the method by which a given user behavior, temporal event, or point in time is selected is a matter of design choice.

In certain embodiments, the individual features of a pluggable feature pack 308 may be invoked by the endpoint agent 306 according to the context of a particular user behavior. As an example, the context may be the user enacting the user behavior, their associated risk classification, which resource they may be requesting, the point in time the user behavior is enacted, and so forth. In certain embodiments, the pluggable feature packs 308 may be sourced from various cloud services 206. In certain embodiments, the pluggable feature packs 308 may be dynamically sourced from various cloud services 206 by the endpoint agent 306 on an as-need basis.

In certain embodiments, the endpoint agent 306 may be implemented with additional functionalities, such as security analytics 310, which may include event analytics and/or video analytics. In certain embodiments, the security analytics 310 functionality may include analysis of various user behaviors, described in greater detail herein. In certain embodiments, the endpoint agent 306 may be implemented with a thin hypervisor 315, which can be run at Ring −1, thereby providing protection for the endpoint agent 306 in the event of a breach. As used herein, a thin hypervisor broadly refers to a simplified, OS-dependent hypervisor implemented to increase security. As likewise used herein, Ring −1 broadly refers to approaches allowing guest operating systems to run Ring 0 (i.e., kernel) operations without affecting other guests or the host OS. Those of skill in the art will recognize that many such embodiments and examples are possible. Accordingly, the foregoing is not intended to limit the spirit, scope or intent of the invention.

Figure 4:
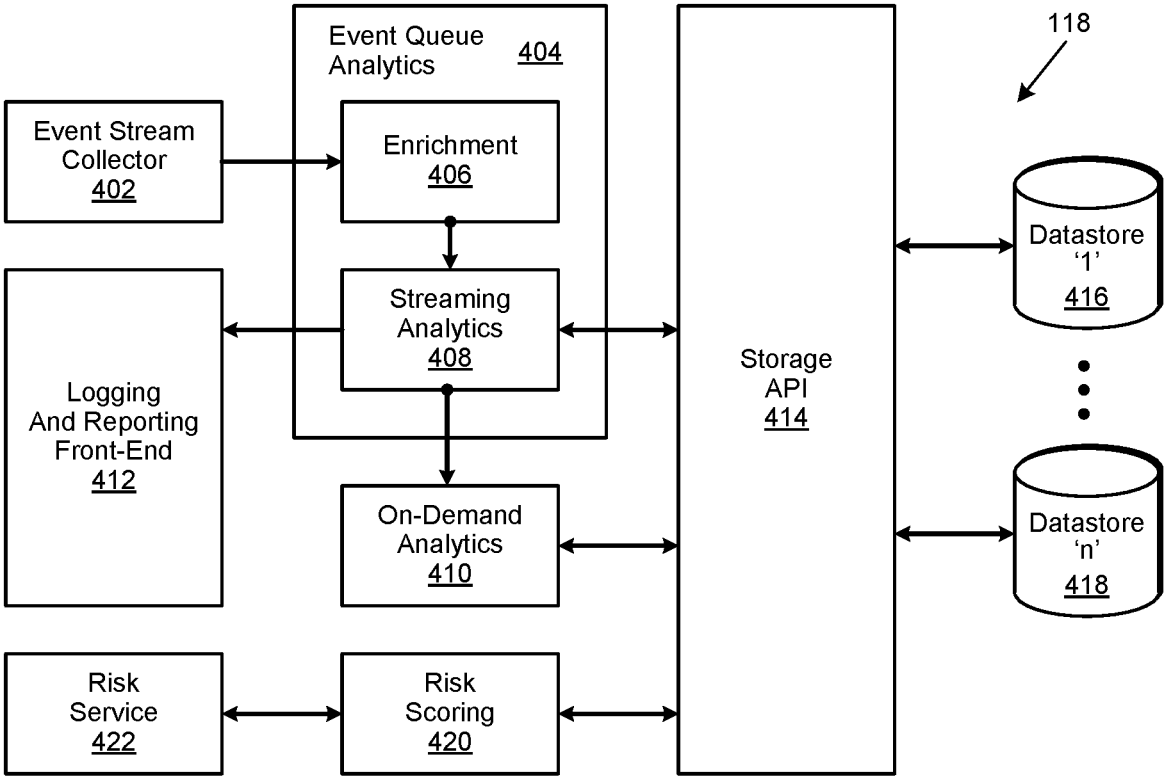
FIG. 4 is a simplified block diagram of a security analytics system.

FIG. 4 is a simplified block diagram of an exemplary security analytics system 118 that may be implemented in certain embodiments. In certain embodiments, the security analytics system 118 shown in FIG. 4 may include an event queue analytics 404 module, described in greater detail herein. In certain embodiments, the event queue analytics 404 sub-system may be implemented to include an enrichment 406 module and a streaming analytics 408 module. In certain embodiments, the security analytics system 118 may be implemented to provide log storage, reporting, and analytics capable of performing streaming 408 and on-demand 410 analytics operations. In certain embodiments, such operations may be associated with defining and managing a user profile, detecting anomalous, abnormal, unexpected or malicious user behavior, adaptively responding to mitigate risk, or a combination thereof.

In certain embodiments, the security analytics system 118 may be implemented to provide a uniform platform for storing events and contextual information associated with various user behaviors and performing longitudinal analytics. As used herein, longitudinal analytics broadly refers to performing analytics of user behaviors occurring over a particular period of time. As an example, a user may iteratively attempt to access certain proprietary information stored in various locations. In addition, the attempts may occur over a brief period of time. To continue the example, the fact that the information the user is attempting to access is proprietary, that it is stored in various locations, and the attempts are occurring in a brief period of time, in combination, may indicate the user behavior enacted by the user is suspicious. As another example, certain entity identifier information (e.g., a user name) associated with a user may change over time. In this example, the change in user name, during a particular period of time or at a particular point in time, may represent suspicious user behavior.

In certain embodiments, the security analytics system 118 may be implemented to be scalable. In certain embodiments, the security analytics system 118 may be implemented in a centralized location, such as a corporate data center. In these embodiments, additional resources may be added to the security analytics system 118 as needs grow. In certain embodiments, the security analytics system 118 may be implemented as a distributed system. In these embodiments, the security analytics system 118 may span multiple information handling systems. In certain embodiments, the security analytics system 118 may be implemented in a cloud environment. In certain embodiments, the security analytics system 118 may be implemented in a virtual machine (VM) environment. In such embodiments, the VM environment may be configured to dynamically and seamlessly scale the security analytics system 118 as needed. Skilled practitioners of the art will recognize that many such embodiments are possible. Accordingly, the foregoing is not intended to limit the spirit, scope or intent of the invention.

In certain embodiments, an event stream collector 402 may be implemented to collect event and related contextual information, described in greater detail herein, associated with various user behaviors. In these embodiments, the method by which the event and contextual information is selected to be collected by the event stream collector 402 is a matter of design choice. In certain embodiments, the event and contextual information collected by the event stream collector 402 may be processed by an enrichment module 406 to generate enriched user behavior information. In certain embodiments, the enrichment may include certain contextual information related to a particular user behavior or event. In certain embodiments, the enrichment may include certain temporal information, such as timestamp information, related to a particular user behavior or event.

In certain embodiments, enriched user behavior information may be provided by the enrichment module 406 to a streaming 408 analytics module. In turn, the streaming 408 analytics module may provide some or all of the enriched user behavior information to an on-demand 410 analytics module. As used herein, streaming 408 analytics broadly refers to analytics performed in near real-time on enriched user behavior information as it is received. Likewise, on-demand 410 analytics broadly refers herein to analytics performed, as they are requested, on enriched user behavior information after it has been received. In certain embodiments, the enriched user behavior information may be associated with a particular event. In certain embodiments, the enrichment 406 and streaming analytics 408 modules may be implemented to perform event queue analytics 404 operations.

In certain embodiments, the on-demand 410 analytics may be performed on enriched user behavior associated with a particular interval of, or point in, time. In certain embodiments, the streaming 408 or on-demand 410 analytics may be performed on enriched user behavior associated with a particular user, group of users, one or more entities, or a combination thereof. In certain embodiments, the streaming 408 or on-demand 410 analytics may be performed on enriched user behavior associated with a particular resource, such as a facility, system, datastore, or service. Those of skill in the art will recognize that many such embodiments are possible. Accordingly, the foregoing is not intended to limit the spirit, scope or intent of the invention.

In certain embodiments, the results of various analytics operations performed by the streaming analytics module 408 or on-demand analytics module 410 may be provided to a storage Application Program Interface (API) 414. In turn, the storage API 412 may be implemented to provide access to various datastores '1' 416 through 'n' 418, which in turn are used to store the results of the analytics operations. In certain embodiments, the security analytics system 118 may be implemented with a logging and reporting front-end 412, which is used to receive the results of analytics operations performed by the streaming 408 analytics module. In certain embodiments, the datastores '1' 416 through 'n' 418 may variously include a datastore of entity identifiers, temporal events, or a combination thereof.

In certain embodiments, the security analytics system 118 may include a risk scoring 420 module implemented to perform risk scoring operations, described in greater detail herein. In certain embodiments, functionalities of the risk scoring 420 module may be provided in the form of a risk management service 422. In certain embodiments, the risk management service 422 may be implemented to perform operations associated with defining and managing a user profile. In certain embodiments, the risk management service 422 may be implemented to perform operations associated with detecting anomalous, abnormal, unexpected or malicious user behavior and adaptively responding to mitigate risk. In certain embodiments, the risk management service 422 may be implemented to provide the results of various analytics operations performed by the streaming 406 or on-demand 408 analytics modules. In certain embodiments, the risk management service 422 may be implemented to use the storage API 412 to access various enhanced cyber behavior and analytics information stored on the datastores '1' 414 through 'n' 416. Skilled practitioners of the art will recognize that many such embodiments are possible. Accordingly, the foregoing is not intended to limit the spirit, scope or intent of the invention.

Figure 5:
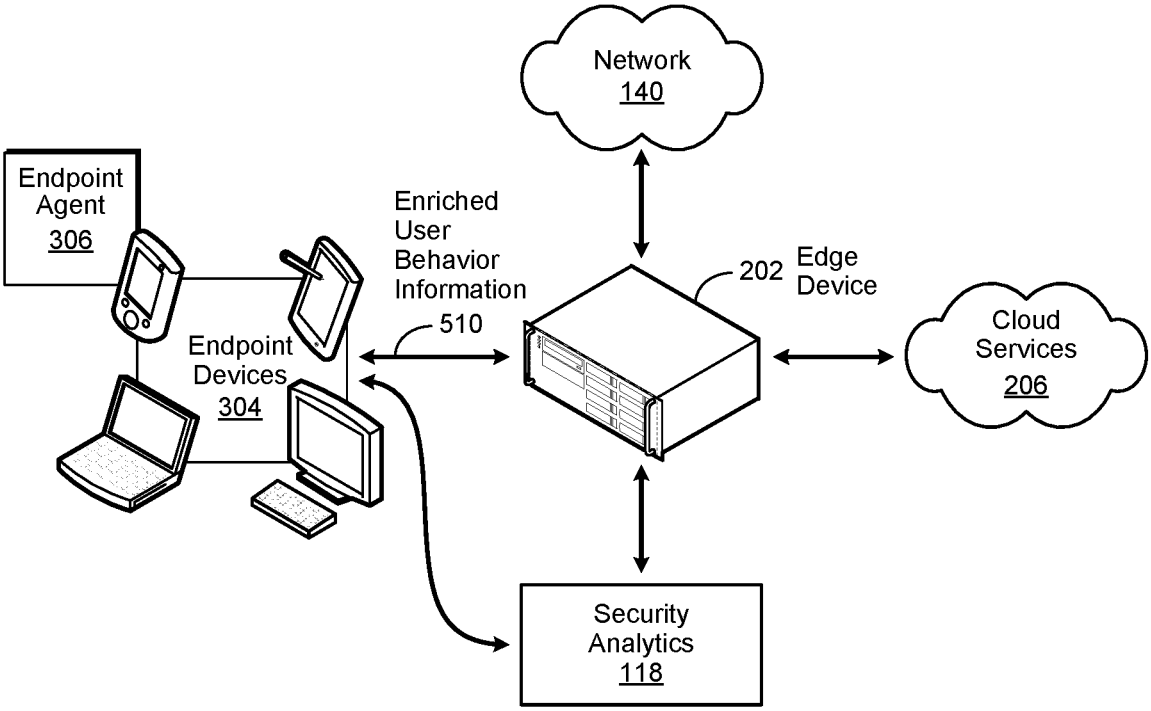
FIG. 5 is a simplified block diagram of a security analytics system.

FIG. 5 is a simplified block diagram of the operation of an exemplary security analytics system that may be implemented in the disclosed system. In certain embodiments, the security analytics system 118 may be implemented to perform operations associated with detecting anomalous, abnormal, unexpected or malicious user behavior. In certain embodiments, the security analytics system 118 may be implemented in combination with one or more endpoint agents 306, one or more edge devices 202, various cloud services 206, and a network 140 to perform such operations.

In certain embodiments, the network edge device 202 may be implemented in a bridge, a firewall, or a passive monitoring configuration. In certain embodiments, the edge device 202 may be implemented as software running on an information handling system. In certain embodiments, the network edge device 202 may be implemented to provide integrated logging, updating and control. In certain embodiments, the edge device 202 may be implemented to receive network requests and context-sensitive user behavior information in the form of enriched user behavior information 510, described in greater detail herein, from an endpoint agent 306, likewise described in greater detail herein.

In certain embodiments, the security analytics system 118 may be implemented as both a source and a sink of user behavior information. In certain embodiments, the security analytics system 118 may be implemented to serve requests for user/resource risk data. In certain embodiments, the edge device 202 and the endpoint agent 306, individually or in combination, may provide certain user behavior information to the security analytics system 118 using either push or pull approaches familiar to skilled practitioners of the art.

As described in greater detail herein, the edge device 202 may be implemented in certain embodiments to receive enriched user behavior information 510 from the endpoint agent 306. It will be appreciated that such enriched user behavior information 510 will likely not be available for provision to the edge device 202 when an endpoint agent 306 is not implemented for a corresponding endpoint device 304. However, the lack of such enriched user behavior information 510 may be accommodated in various embodiments, albeit with reduced functionality related to operations associated with defining and managing a user profile, detecting anomalous, abnormal, unexpected or malicious user behavior, mitigating associated risk, or a combination thereof.

In certain embodiments, a given user behavior may be enriched by an associated endpoint agent 306 attaching contextual information to a request. In certain embodiments, the context is embedded within a network request, which is then provided as enriched user behavior information 510. In certain embodiments, the contextual information may be concatenated, or appended, to a request, which in turn may be provided as enriched user behavior information 510. In these embodiments, the enriched user behavior information 510 may be unpacked upon receipt and parsed to separate the request and its associated contextual information. Certain embodiments of the disclosure reflect an appreciation that one possible disadvantage of such an approach is that it may perturb certain Intrusion Detection System and/or Intrusion Detection Prevention (IDS/IDP) systems implemented on a network 140.

In certain embodiments, new flow requests may be accompanied by a contextual information packet sent to the edge device 202. In these embodiments, the new flow requests may be provided as enriched user behavior information 510. In certain embodiments, the endpoint agent 306 may also send updated contextual information to the edge device 202 once it becomes available. As an example, an endpoint agent 306 may share a list of files that have been read by a current process at any point in time once the information has been collected. To continue the example, such a list of files may be used to determine which data the endpoint agent 306 may be attempting to exfiltrate.

In certain embodiments, point analytics processes executing on the edge device 202 may request a particular service. As an example, risk scores associated with a particular event on a per-user basis may be requested. In certain embodiments, the service may be requested from the security analytics system 118. In certain embodiments, the service may be requested from various cloud services 206.

In certain embodiments, contextual information associated with a particular user behavior may be attached to various network service requests. In certain embodiments, the request may be wrapped and then handled by proxy. In certain embodiments, a small packet of contextual information associated with a user behavior may be sent with a service request. In certain embodiments, service requests may be related to Domain Name Service (DNS), web browsing activity, email, and so forth, all of which are essentially requests for service by an endpoint device 304. In certain embodiments, such service requests may be associated with temporal event information, described in greater detail herein. Consequently, such requests can be enriched by the addition of user behavior contextual information (e.g., UserAccount, interactive/automated, data-touched, temporal event information, etc.). Accordingly, the edge device 202 can then use this information to manage the appropriate response to submitted requests.

In certain embodiments, the security analytics system 118 may be implemented in different operational configurations. In certain embodiments, the security analytics system 118 may be implemented by using the endpoint agent 306. In certain embodiments, the security analytics system 118 may be implemented by using endpoint agent 306 in combination with the edge device 202. In certain embodiments, the cloud services 206 may likewise be implemented for use by the endpoint agent 306, the edge device 202, and the security analytics system 118, individually or in combination. In these embodiments, the security analytics system 118 may be primarily oriented to performing risk assessment operations related to user actions, program actions, data accesses, or a combination thereof. In certain embodiments, program actions may be treated as a proxy for the user.

In certain embodiments, the endpoint agent 306 may be implemented to update the security analytics system 118 with user behavior and associated contextual information, thereby allowing an offload of certain analytics processing overhead. In certain embodiments, this approach allows for longitudinal risk scoring, which assesses risk associated with certain user behavior during a particular interval of time. In certain embodiments, the security analytics system 118 may be implemented to access risk scores associated with the same user account, but accrued on different endpoint devices 304. It will be appreciated that such an approach may prove advantageous when an adversary is "moving sideways" through a network environment, using different endpoint devices 304 to collect information.

In certain embodiments, the security analytics system 118 may be primarily oriented to applying risk mitigations in a way that maximizes security effort return-on-investment (ROI). In certain embodiments, this approach may be accomplished by providing additional contextual and user behavior information associated with user requests. As an example, a web gateway may not concern itself with why a particular file is being requested by a certain entity at a particular point in time. Accordingly, if the file cannot be identified as malicious or harmless, there is no context available to determine how, or if, to proceed. To extend the example, the edge device 202 and security analytics system 118 may be coupled such that requests can be contextualized and fitted into a framework that evaluates their associated risk. Certain embodiments of the disclosure reflect an appreciation that such an approach works well with web-based data loss protection (DLP) approaches, as each transfer is no longer examined in isolation, but in the broader context of an identified user's actions, at a particular time, on the network 140.

As another example, the security analytics system 118 may be implemented to perform risk scoring processes to decide whether to block or allow unusual flows. Certain embodiments of the disclosure reflect an appreciation that such an approach is highly applicable to defending against point-of-sale (POS) malware, a breach technique that has become increasingly more common in recent years. Certain embodiments of the disclosure likewise reflect an appreciation that while various edge device 202 implementations may not stop all such exfiltrations, they may be able to complicate the task for the attacker.

In certain embodiments, the security analytics system 118 may be primarily oriented to maximally leverage contextual information associated with various user behaviors within the system. In certain embodiments, data flow tracking is performed by one or more endpoint agents 306, which allows the quantity and type of information associated with particular hosts to be measured. In turn, this information may be used to determine how the edge device 202 handles requests. By contextualizing such user behavior on the network 140, the security analytics system 118 can provide intelligent protection, making decisions that make sense in the broader context of an organization's activities. Certain embodiments of the disclosure reflect an appreciation that one advantage to such an approach is that information flowing through an organization, and the networks they employ, should be trackable, and substantial data breaches preventable. Skilled practitioners of the art will recognize that many such embodiments and examples are possible. Accordingly, the foregoing is not intended to limit the spirit, scope or intent of the invention.

Figure 6A:
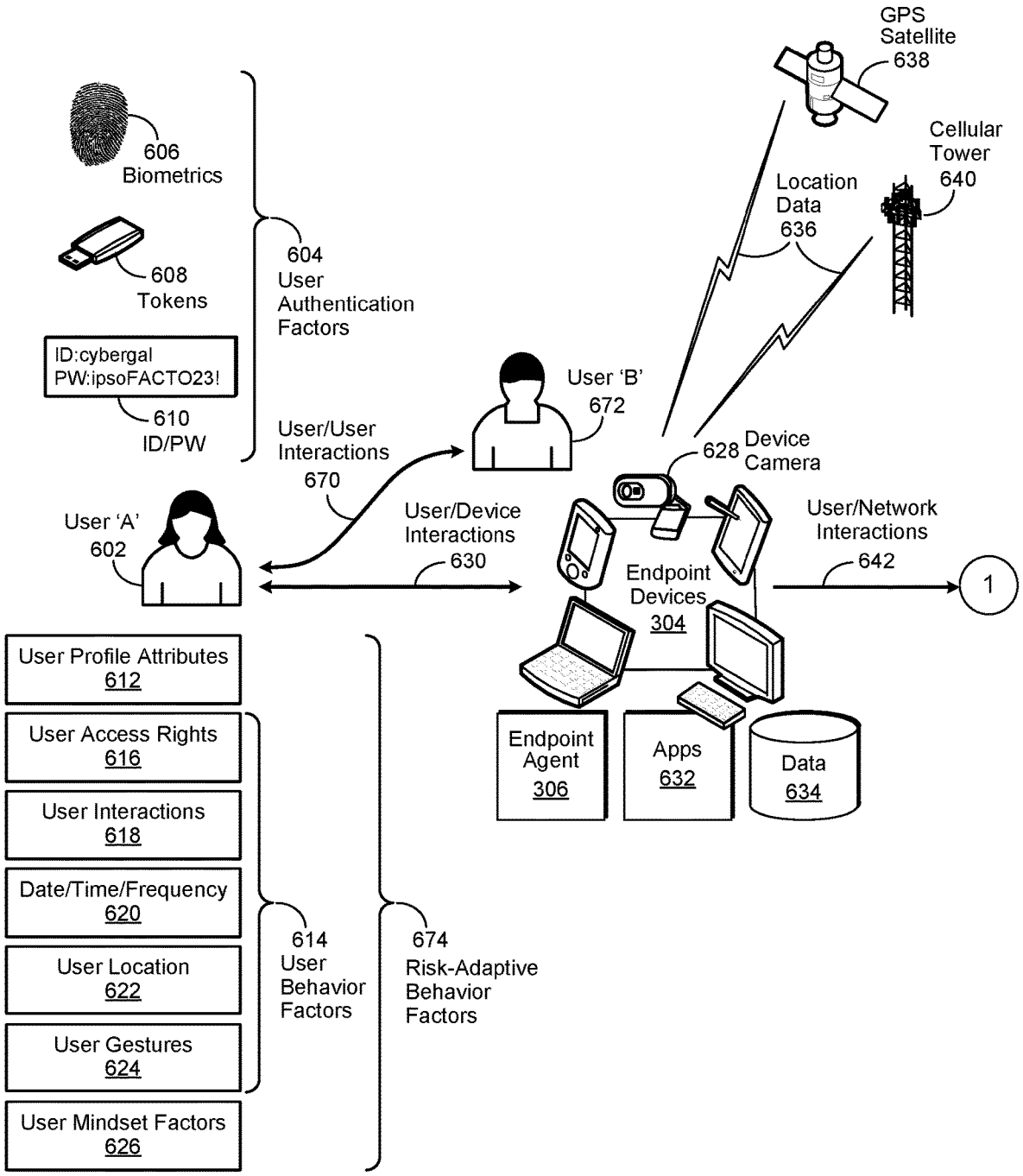
FIGS. 6*a* and 6*b* show a block diagram of a security analytics system environment.
Figure 6B:
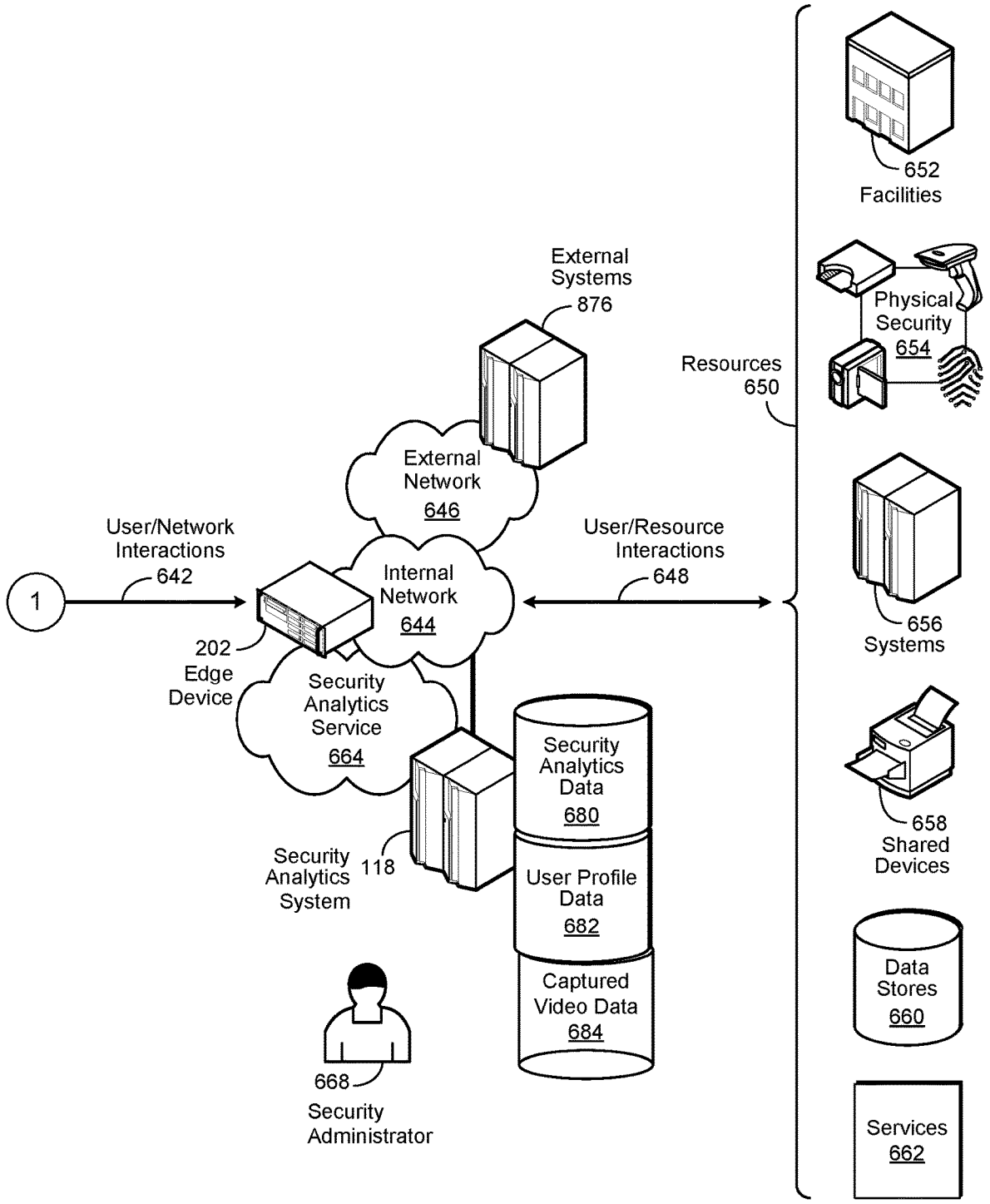

FIGS. 6*a* and 6*b* show a block diagram of a security analytics environment in which certain embodiments of the disclosed invention may operate. In certain embodiments, analyses performed by a security analytics system 118 may be used to identify anomalous, abnormal, unexpected or malicious behavior associated with an entity. In certain embodiments, the anomalous, abnormal, unexpected or malicious behavior may be identified at a particular point in time, during the occurrence of an event, the enactment of a user behavior, or a combination thereof.

As used herein, an entity broadly refers to something that exists as itself, whether physically or abstractly. In certain embodiments, an entity may be an individual user, a group, an organization, or a government. In certain embodiments, an entity may likewise be an item, a device, such as endpoint 304 and edge 202 devices, a network, such as an internal 644 and external 646 networks, a domain, an operation, or a process. In certain embodiments, an entity may be a resource 650, such as a geographical location or formation, a physical facility 652, such as a venue, various physical security devices 654, a system 656, shared devices 658, such as printer, scanner, or copier, a data store 660, or a service 662, such as a service 662 operating in a cloud environment.

As likewise used herein, an event broadly refers to the occurrence of an action performed by an entity. In certain embodiments, the action may be directly associated with a user behavior, described in greater detail herein. As an example, a first user may attach a binary file infected with a virus to an email that is subsequently sent to a second user. In this example, the act of attaching the binary file to the email is directly associated with a user behavior enacted by the first user. In certain embodiments, the action may be indirectly associated with a user behavior. To continue the example, the recipient of the email may open the infected binary file, and as a result, infect their computer with malware. To further continue the example, the act of opening the infected binary file is directly associated with a user behavior enacted by the second user. However, the infection of the email recipient's computer by the infected binary file is indirectly associated with the described user behavior enacted by the second user.

In certain embodiments, information associated with such user behavior may be stored in a user profile. As used herein, a user profile broadly refers to a collection of information that uniquely describes a user's identity and their associated behavior, whether the behavior occurs within a physical realm or cyberspace. In certain embodiments, the user profile may be stored in a repository of user profile data 682. In certain embodiments, the user profile may include user profile attributes 612, user behavior factors 614, user mindset factors 626, or a combination thereof.

As used herein, a user profile attribute 612 broadly refers to data or metadata that can be used, individually or in combination with other user profile attributes 612, to uniquely ascertain the identity of an entity. In certain embodiments, the user profile attributes 612 may include certain personal information. In certain embodiments, the personal information may include non-sensitive personal information associated with a user, such as their name, title, position, role, and responsibilities. In certain embodiments, the personal information may likewise include technical skill level information, peer information, expense account information, paid time off (PTO) information, data analysis information, insider information, misconfiguration information, third party information, or a combination thereof.

In certain embodiments, the personal information may contain sensitive personal information associated with a user. As used herein, sensitive personal information (SPI), also commonly referred to as personally identifiable information (PII), broadly refers to any information usable to ascertain the identity of a user, either by itself, or in combination with other information, such as contextual information described in greater detail herein. Examples of SPI may include the full or legal name of a user, initials or nicknames, place and date of birth, home and business addresses, personal and business telephone numbers, their gender, and other genetic information.

Additional examples of SPI may include government-issued identifiers, such as a Social Security Number (SSN) or a passport number, vehicle registration plate and serial numbers, and driver's license numbers. Other examples of SPI may include certain email addresses and social media identifiers, financial account information, such as credit and debit card numbers, and other digital identity information. Yet other examples of SPI may include employer-issued identifiers, financial transaction information, credit scores, electronic medical records (EMRs), insurance claim information, personal correspondence, and so forth. Further examples of SPI may include user authentication factors 604.

In certain embodiments, the user authentication factors 604 may be used to authenticate the identity of a user, such as user 'A' 602 or 'B' 672. In certain embodiments, the user authentication factors 604 may be used to ensure that a particular user, such as user 'A' 602 or 'B' 672, is associated with their corresponding user profile, rather than a user profile associated with another user. In certain embodiments, the user authentication factors 604 may include a user's biometrics 606 (e.g., a fingerprint or retinal scan), tokens 608 (e.g., a dongle containing cryptographic keys), user identifiers and passwords (ID/PW) 610, and personal identification numbers (PINs).

As used herein, a user behavior factor 614 broadly refers to information associated with a user's behavior, whether the behavior occurs within a physical realm or cyberspace. In certain embodiments, the user behavior factors 614 may include the user's access rights 616, the user's interactions 618, and the date/time/frequency 620 of those interactions 618. In certain embodiments, the user behavior factors 614 may likewise include the user's location 622 when the interactions 618 are enacted, and the user gestures 624 used to enact the interactions 618.

In certain embodiments, the user gestures 624 may include key strokes on a keypad, a cursor movement, a mouse movement or click, a finger swipe, tap, or other hand gesture, an eye movement, or some combination thereof. In certain embodiments, the user gestures 624 may likewise include the cadence of the user's keystrokes, the motion, force and duration of a hand or finger gesture, the rapidity and direction of various eye movements, or some combination thereof. In certain embodiments, the user gestures 624 may include various audio or verbal commands performed by the user.

In various embodiments, certain date/time/frequency 620 user behavior factors 614 may be implemented as ontological or societal time, or a combination thereof. As used herein, ontological time broadly refers to how one instant in time relates to another in a chronological sense. As an example, a first user behavior enacted at 12:00 noon on May 17, 2017 may occur prior to a second user behavior enacted at 6:39 PM on May 18, 2018. Skilled practitioners of the art will recognize one value of ontological time is to determine the order in which various user behaviors have been enacted.

As likewise used herein, societal time broadly refers to the correlation of certain user profile attributes 612, user behavior factors 614, user mindset factors 626, or a combination thereof, to one or more instants in time. As an example, user 'A' 602 may access a particular system 656 to download a customer list at 3:47 PM on Nov. 3, 2017. Analysis of their user behavior profile indicates that it is not unusual for user 'A' 602 to download the customer list on a weekly basis. However, examination of their user behavior profile also indicates that user 'A' 602 forwarded the downloaded customer list in an email message to user 'B' 672 at 3:49 PM that same day. Furthermore, there is no record in their user behavior profile that user 'A' 602 has ever communicated with user 'B' 672 in the past. Moreover, it may be determined that user 'B' 672 is employed by a competitor. Accordingly, the correlation of user 'A' 602 downloading the customer list at one point in time, and then forwarding the customer list to user 'B' 672 at a second point in time shortly thereafter, is an example of societal time.

In a variation of the prior example, user 'A' 602 may download the customer list at 3:47 PM on Nov. 3, 2017. However, instead of immediately forwarding the customer list to user 'B' 672, user 'A' 602 leaves for a two week vacation. Upon their return, they forward the previously-downloaded customer list to user 'B' 672 at 9:14 AM on Nov. 20, 2017. From an ontological time perspective, it has been two weeks since user 'A' 602 accessed the system 656 to download the customer list. However, from a societal time perspective, they have still forwarded the customer list to user 'B' 672, despite two weeks having elapsed since the customer list was originally downloaded.

Accordingly, the correlation of user 'A' 602 downloading the customer list at one point in time, and then forwarding the customer list to user 'B' 672 at a much later point in time, is another example of societal time. More particularly, it may be inferred that the intent of user 'A' 602 did not change during the two weeks they were on vacation. Furthermore, user 'A' 602 may have attempted to mask an intended malicious act by letting some period of time elapse between the time they originally downloaded the customer list and when they eventually forwarded it to user 'B' 672. From the foregoing, those of skill in the art will recognize that the use of societal time may be advantageous in determining whether a particular user behavior is acceptable, anomalous, abnormal, unexpected or malicious.

As used herein, mindset factors 626 broadly refer to information used to determine the mental state of a user at a particular point in time, during the occurrence of an event, an enactment of a user behavior, or combination thereof. As used herein, mental state broadly refers to a hypothetical state corresponding to the way a user may be thinking or feeling. In certain embodiments, the user mindset factors 626 may include a personality type. Examples of known approaches for determining a personality type include Jungian types, Myers-Briggs type indicators, Keirsy Temperament Sorter, Socionics, Enneagram of Personality, and Eyseneck's three-factor model.

In certain embodiments, the mindset factors 626 may include various behavioral biometrics. As likewise used herein, a behavioral biometric broadly refers to a physiological indication of a user's mental state. Examples of behavioral biometrics may include a user's blood pressure, heart rate, respiratory rate, eye movements and iris dilation, facial expressions, body language, tone and pitch of voice, speech patterns, and so forth.

In certain embodiments, the security analytics system 118 may be implemented to process certain entity information associated with providing resolution of the identity of an entity at a particular point in time. As likewise used herein, entity information broadly refers to information associated with a particular entity. In various embodiments, the entity information may include certain types of content. In certain embodiments, such content may include text, unstructured data, structured data, graphical images, photographs, audio recordings, video recordings, biometric information, and so forth. In certain embodiments, the entity information may include metadata. In various embodiments, the metadata may include entity attributes, which in turn may include certain entity identifier types or classifications.

In various embodiments, the security analytics system 118 may be implemented to use certain entity identifier information to ascertain the identity of an associated entity at a particular point in time. As used herein, entity identifier information broadly refers to an information element of an entity that can be used to ascertain or corroborate the identity of an associated entity at a particular point in time. In certain embodiments, the entity identifier information may include user authentication factors 604, user profile attributes 612, location data 636, information associated with various endpoint 304 and edge 202 devices, internal 644 and external 646 networks, resource entities 650, or a combination thereof.

In certain embodiments, the entity identifier information may include temporal information. As used herein, temporal information broadly refers to a measure of time (e.g., a date, timestamp, etc.), a measure of a duration of time (e.g., a minute, hour, day, etc.), or a measure of an interval of time (e.g., between Jun. 3, 2017 and Mar. 4, 2018, etc.). In certain embodiments, the temporal information may be associated with an event associated with a particular point in time. As used herein, such a temporal event broadly refers to an occurrence, action or activity enacted by, or associated with, an entity at a particular point in time.

Examples of such temporal events include making a phone call, sending a text or an email, using a device, such as an endpoint device 304, accessing a system 656, interacting with a physical security device 645 or shared devices 658, and entering a physical facility 652. Other examples of temporal events include uploading, transferring, downloading, modifying, or deleting data, such as data stored in a datastore 660, or accessing a service 662. Yet other examples of temporal events include user/user 670 interactions between two or more users, user/device 630 interactions between a user and a device, user/network 642 interactions between a user and a network, and user/resource 648 interactions between a user and a resource 650, whether physical or otherwise. Yet still other examples of temporal events include a change in name, address, physical location, occupation, position, role, marital status, gender, association, affiliation, or assignment.

As likewise used herein, temporal event information broadly refers to temporal information associated with a particular event. In various embodiments, the temporal event information may include certain types of content. In certain embodiments, such types of content may include text, unstructured data, structured data, graphical images, photographs, audio recordings, video recordings, and so forth. In certain embodiments, the entity information may include metadata. In various embodiments, the metadata may include temporal event attributes, which in turn may include certain entity identifier types or classifications, described in greater detail herein.

In certain embodiments, the security analytics system 118 may be implemented to use information associated with such temporal resolution of an entity's identity to assess the risk associated with a particular entity, at a particular point in time, and adaptively respond with an associated response. In certain embodiments, the security analytics system 118 may be implemented to respond to such assessments in order to reduce operational overhead and improve system efficiency while maintaining security integrity. In certain embodiments, the response to such assessments may be performed by a security administrator 668. Accordingly, certain embodiments of the invention may be directed towards assessing the risk associated with the affirmative resolution of the identity of an entity at a particular point in time in combination with its associated contextual information. Consequently, the security analytics system 118 may be more oriented in various embodiments to risk adaptation than to security administration.

In certain embodiments, the security analytics system 118 may be implemented to use information associated with certain user behavior elements to resolve the identity of an entity at a particular point in time. A user behavior element, as used herein, broadly refers to a discrete element of a user's behavior during the performance of a particular operation in a physical realm, cyberspace, or a combination thereof. In certain embodiments, such user behavior elements may be associated with a user/device 630, a user/network 642, a user/resource 648, a user/user 660 interaction, or a combination thereof.

As an example, user 'A' 602 may use an endpoint device 304 to browse a particular web page on a news site on the Internet. In this example, the individual actions performed by user 'A' 602 to access the web page are user behavior elements that constitute a user behavior. As another example, user 'A' 602 may use an endpoint device 304 to download a data file from a particular system 656. In this example, the individual actions performed by user 'A' 602 to download the data file, including the use of one or more user authentication factors 604 for user authentication, are user behavior elements that constitute a user behavior. In certain embodiments, the user/device 630 interactions may include an interaction between a user, such as user 'A' 602 or 'B' 672, and an endpoint device 304.

In certain embodiments, the user/device 630 interaction may include interaction with an endpoint device 304 that is not connected to a network at the time the interaction occurs. As an example, user 'A' 602 or 'B' 672 may interact with an endpoint device 304 that is offline, using applications 632, accessing data 634, or a combination thereof, it may contain. Those user/device 630 interactions, or their result, may be stored on the endpoint device 304 and then be accessed or retrieved at a later time once the endpoint device 304 is connected to the internal 644 or external 646 networks. In certain embodiments, an endpoint agent 306 may be implemented to store the user/device 630 interactions when the user device 304 is offline.

In certain embodiments, an endpoint device 304 may be implemented with a device camera 628. In certain embodiments, the device camera 628 may be integrated into the endpoint device. In certain embodiments, the device camera 628 may be implemented as a separate device configured to interoperate with the endpoint device 304. As an example, a webcam familiar to those of skill in the art may be implemented receive and communicate various image and audio signals to an endpoint device 304 via a Universal Serial Bus (USB) interface.

In certain embodiments, the device camera 628 may be implemented to capture provide user/device 630 interaction information to an endpoint agent 306. In various embodiments, the device camera 628 may be implemented to provide surveillance information related to certain user/device 630 or user/user 670 interactions. In certain embodiments, the surveillance information may be used by the security analytics system 118 to detect anomalous, abnormal, unexpected or malicious behavior associated with an entity, such as user 'A' 602 or user 'B' 672. In certain embodiments, the entity may or may not be aware that the device camera 628 is providing such surveillance information. As an example, a visual indicator associated with the device camera 628, such as a "record" light, may or may not be activated when it is recording surveillance images.

In certain embodiments, the endpoint device 304 may be used to communicate data through the use of an internal network 644, an external network 646, or a combination thereof. In certain embodiments, the internal 644 and the external 646 networks may include a public network, such as the Internet, a physical private network, a virtual private network (VPN), or any combination thereof. In certain embodiments, the internal 644 and external 646 networks may likewise include a wireless network, including a personal area network (PAN), based on technologies such as Bluetooth. In various embodiments, the wireless network may include a wireless local area network (WLAN), based on variations of the IEEE 802.11 specification, commonly referred to as WiFi. In certain embodiments, the wireless network may include a wireless wide area network (WWAN) based on an industry standard including various 3G, 4G and 5G technologies.

In certain embodiments, the user/user 670 interactions may include interactions between two or more users, such as user 'A' 602 and 'B' 662. In certain embodiments, the user/user interactions 670 may be physical, such as a face-to-face meeting, via a user/device 630 interaction, a user/network 642 interaction, a user/resource 648 interaction, or some combination thereof. In certain embodiments, the user/user 670 interaction may include a face-to-face verbal exchange. In certain embodiments, the user/user 670 interaction may include a written exchange, such as text written on a sheet of paper. In certain embodiments, the user/user 670 interaction may include a face-to-face exchange of gestures, such as a sign language exchange.

In certain embodiments, temporal event information associated with various user/device 630, user/network 642, user/resource 648, or user/user 670 interactions may be collected and used to provide real-time resolution of the identity of an entity at a particular point in time. Those of skill in the art will recognize that many such examples of user/device 630, user/network 642, user/resource 648, and user/user 660 interactions are possible. Accordingly, the foregoing is not intended to limit the spirit, scope or intent of the invention.

In various embodiments, the security analytics system 118 may be implemented to process certain contextual information in the performance of certain security analytic operations. As used herein, contextual information broadly refers to any information, directly or indirectly, individually or in combination, related to a particular user behavior. In certain embodiments, user behavior may include a user's physical behavior, cyber behavior, or a combination thereof. As likewise used herein, a user's physical behavior broadly refers to any user behavior occurring within a physical realm, such as speaking, gesturing, facial patterns or expressions, walking, and so forth. More particularly, such physical behavior may include any action enacted by a user that can be objectively observed, or indirectly inferred, within a physical realm. In certain embodiments, the objective observation, or indirect inference, of the physical behavior may be performed electronically.

In certain embodiments, the contextual information may include location data 636. In certain embodiments, the endpoint device 304 may be configured to receive such location data 636, which is used as a data source for determining the user's location 622. In certain embodiments, the location data 636 may include Global Positioning System (GPS) data provided by a GPS satellite 638. In certain embodiments, the location data 636 may include location data 636 provided by a wireless network, such as from a cellular network tower 640. In certain embodiments (not shown), the location data 636 may include various Internet Protocol (IP) or other network address information assigned to the endpoint 304 or edge 202 device. In certain embodiments (also not shown), the location data 636 may include recognizable structures or physical addresses within a digital image or video recording.

In certain embodiments, the endpoint devices 304 may include an input device (not shown), such as a keypad, magnetic card reader, token interface, biometric sensor, and so forth. In certain embodiments, such endpoint devices 304 may be directly, or indirectly, connected to a particular facility 652, physical security device 654, system 656, or shared device 658. As an example, the endpoint device 304 may be directly connected to an ingress/egress system, such as an electronic lock on a door or an access gate of a parking garage. As another example, the endpoint device 304 may be indirectly connected to a physical security device 654 through a dedicated security network.

In certain embodiments, the security analytics system 118 may be implemented to perform various risk-adaptive protection operations. Risk-adaptive, as used herein, broadly refers to adaptively responding to a risk associated with an electronically-observable user behavior. In various embodiments, the security analytics system 118 may be implemented to perform certain risk-adaptive protection operations by monitoring certain user behaviors, assess the corresponding risk they may represent, individually or in combination, and respond with an associated response. In certain embodiments, such responses may be based upon contextual information, described in greater detail herein, associated with a given user behavior.

In certain embodiments, various risk-adaptive behavior factors 674, likewise described in greater detail herein, may be used to perform the risk-adaptive protection operations. In certain embodiments, the risk-adaptive behavior factors 674 may include user profile attributes 612, user behavior factors 614, user mindset factors 626, or a combination thereof. In these embodiments, the risk-adaptive behavior factors 674 used to perform the risk-adaptive protection operations is a matter of design choice.

In certain embodiments, the security analytics system 118 may be implemented as a stand-alone system. In certain embodiments, the security analytics system 118 may be implemented as a distributed system. In certain embodiment, the security analytics system 118 may be implemented as a virtual system, such as an instantiation of one or more virtual machines (VMs). In certain embodiments, the security analytics system 118 may be implemented as a security analytics service 664. In certain embodiments, the security analytics service 664 may be implemented in a cloud environment familiar to those of skill in the art. In various embodiments, the security analytics system 118 may use data stored in a repository of security analytics data 680 in the performance of certain security analytics operations, described in greater detail herein. Those of skill in the art will recognize that many such embodiments are possible. Accordingly, the foregoing is not intended to limit the spirit, scope or intent of the invention.

Figure 7:
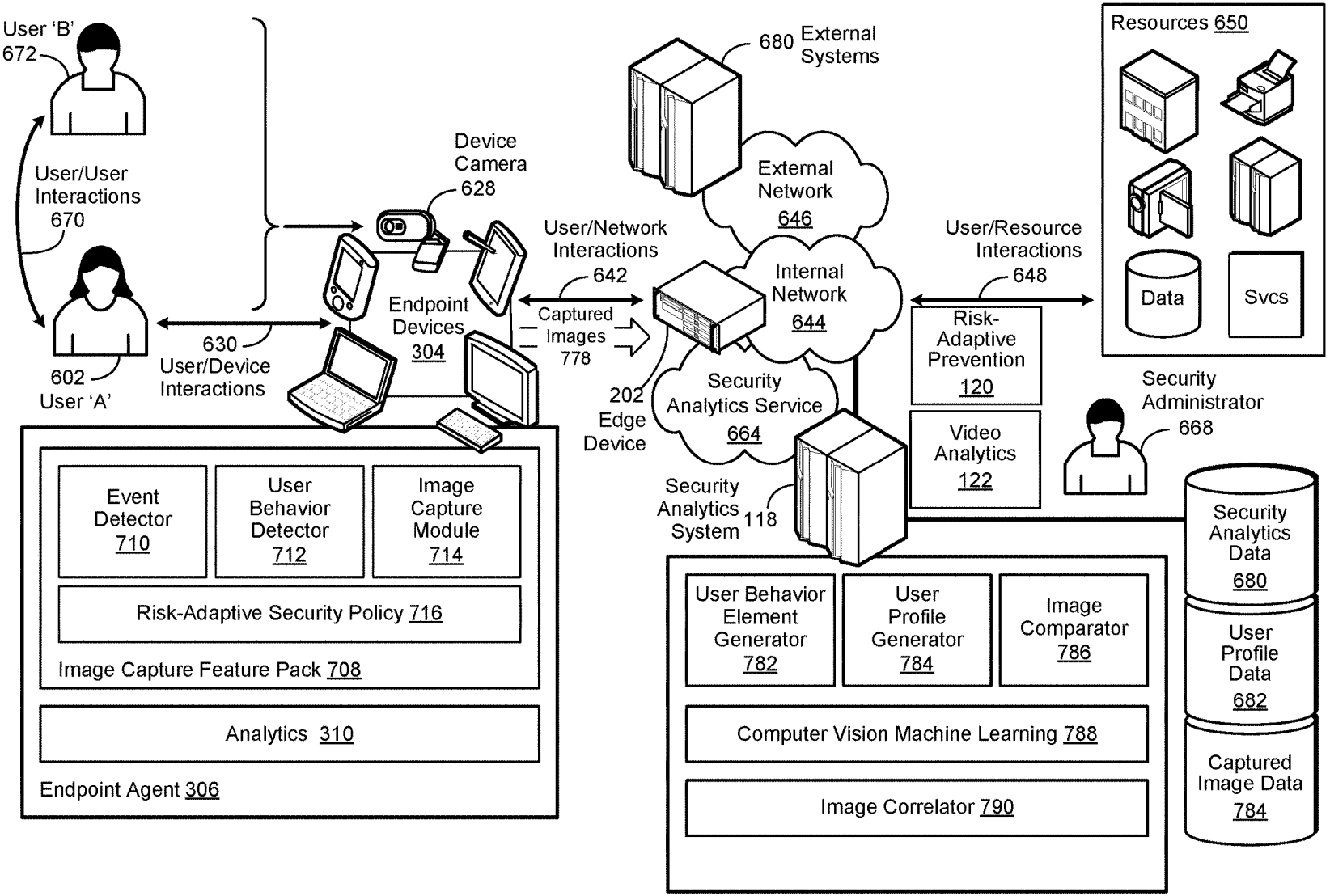
FIG. 7 is a functional block diagram of a security analytics system in which certain embodiments of an image capture system may be employed.

FIG. 7 is a functional block diagram of a security analytics system in which certain embodiments of an image capture system may be employed. In certain embodiments, the security analytics system operates to detect the occurrence of visual hacking. As used herein, visual hacking broadly refers to an act of collecting confidential information by visual means. In certain embodiments, the confidential information may include sensitive personal information (SPI), described in greater detail herein. As an example, an attacker may simply look at the screens of nearby mobile devices, such as a smart phone, tablet, or laptop, or the monitor of a desktop computer or other device, to gather information about their user or owner.

Alternatively, the attacker might also watch a user's interaction with a keyboard or key pad to discern their user ID and password information. Afterwards, such information may be used to mount a brute-force attack to hack or crack various accounts associated with the victim. As another example, the attacker might make a video or take photos of a user's screen or keyboard interactions using a user camera 728, such as a camera integrated into a mobile device. Skilled practitioners of the art will recognize that many such examples of visual hacking are possible. Accordingly, the foregoing is not intended to limit the spirit, scope or intent of the invention.

In certain embodiments, a security analytics system 118, described in greater detail herein, may be implemented to include a risk-adaptive prevention system 120, a video analytics system 122, or both. In certain embodiments, the video analytics system 122 may be used to detect occurrences of visual hacking. In certain embodiments, the security analytics system 118 may likewise be implemented to include repositories of security analytics data 682, user profile data 682, captured video data 684 or a combination thereof. In certain embodiments, the risk-adaptive protection system 120 may be implemented to detect anomalous, abnormal, unexpected or malicious user behavior and adaptively respond to mitigate risk, as described in greater detail herein. In certain embodiments, the security analytics system 118 may be implemented to access the captured video data 684 to perform security analytics operations. In certain embodiments, the security analytics operations include an analysis of the captured video data 684 by the video analytics system 122 to detect an incident of visual hacking.

In certain embodiments, the security analytics system 118 may be implemented to monitor user behavior associated with a user, such as user 'A' 602 or user 'B' 672. In certain embodiments, the user behavior may be monitored during user/device 630, user/network 642, user/resource 648, user/user 670 interactions, or a combination thereof. In certain embodiments, the user/user 670 interactions may occur between a first user, such as user 'A' 602, and a second user, such as user 'B' 672. In certain embodiments, an endpoint agent 306 may be implemented on an endpoint device 304 to perform the user behavior monitoring. In various embodiments, the endpoint agent 306 may be implemented to use images 778 collected by a device camera 628 implemented with the endpoint device 304 to perform certain user behavior monitoring operations, as likewise described in greater detail herein.

In various embodiments, the endpoint agent 306 may be implemented to perform user behavior operations related to the capturing of images only when certain content is being displayed within a UI of an endpoint device. As an example, user behavior operations related to the capturing of images may not be performed when a user is simply browsing various websites. However, they may be performed whenever sensitive, confidential or proprietary content is being displayed within the UI of an associated endpoint device 304. In certain of these embodiments, the endpoint agent 306 may be implemented to determine when the device camera 628 is activated to acquire images under various circumstances that may warrant and analysis of the acquired images. In certain embodiments, the captured images 778 are conveyed to the security system 118 through and device 202. In these embodiments, the determination of under what circumstances the device camera 628 is activated, and the manner in which it is implemented to capture the images 778 during various user behavior operations, is a matter of design choice.

In certain embodiments, the user behavior may be monitored by the endpoint agent 306 during user/device 630 interactions between a user, such as user 'A' 602, and an endpoint device 304. In certain embodiments, the user behavior may be monitored by the endpoint agent 306 during user/network 642 interactions between user 'A' 602 or user 'B' 672, and a network, such as an internal 644 or external 646 network. In certain embodiments, the endpoint agent 306 may be implemented to perform the monitoring of user behavior in combination with the security analytics system 118, the risk-adaptive 120 module, and the video analytics module 122.

In certain embodiments, the endpoint agent 306 may be implemented in combination with the security analytics system 118, the risk-adaptive module 120, and the video analytics module 122 to detect anomalous, abnormal, unexpected or malicious user behavior associated with operations of a targeted application executed at an endpoint device 304. Certain embodiments may detect the occurrence of visual hacking and adaptively respond to mitigate risk. In these embodiments, the response to mitigate risk of visual hacking is matter of design choice. As an example, display of certain content within the User Interface (UI) of an endpoint device 304 may be blocked if an incident of visual hacking is detected. As another example, a user's associated risk score may be revised if an occurrence of visual hacking is detected.

In certain embodiments, the endpoint agent 306 may be implemented to include an image capture feature pack 708 and an analytics 310 module, described in greater detail herein. In certain embodiments, the image capture feature pack 708 may be implemented to include an event detector module 710, a user behavior detector module 712, and an image capture 714 module. In certain embodiments, the event detector 710 module may be implemented to detect event data, likewise described in greater detail herein, resulting from user/device 630, user/network 642, user/resource 648, and user/user 670 interactions. In certain embodiments, the user behavior detector 710 module may be implemented to detect user behavior data, described in greater detail herein, resulting from user/device 630, user/network 642, user/resource 648, and user/user 670 interactions.

In certain embodiments, the image capture module 714 may be implemented to copy frame buffers rendered by a targeted application executed on the endpoint device 304. As an example, the image capture module 714 may capture images from an image acquisition application associated with the device camera 628. In certain embodiments, images captured by the image capture module 714 may be analyzed locally at analytics module 310. In certain embodiments, the captured images 778 are sent by the image capture module 714 sent to the security analytics system 118 in the form of one or more individual digital images. In certain embodiments, the individual digital images may be provided in various file formats, such as Joint Photographic Experts Group (JPEG), Tagged Image File Format (TIFF), or the device camera's 628 native RAW file format. As an example, the image capture module 714 may construct a copy of the frame buffer rendered by the targeted application as an image file, which is then transmitted to the security analytics system 118. In certain embodiments, the captured images 778 may be sent in event data. As an example, API calls made by a targeted application that are intercepted by the image capture module 714 may be sent to the security analytics system 118. In one example, the API calls are used to construct a copy of the frame buffer at the security analytics system 118.

In certain embodiments, the image capture module 714 locally collects multiple images and transmits the captured images in the form of a video recording. In certain embodiments, the video recording may be provided to security analytics system 118 in the form of a continuous sequence of video frames. In certain embodiments, the continuous sequence of video frames are parsed into individual video frames. In certain embodiments, the continuous sequence of video frames provided by the image capture module 714 provide full-motion video when played back. In certain embodiments, the video recording images may be provided to the security analytics system in the form of streaming media, familiar to those of skill in the art.

In certain embodiments, the video recording images may be provided to the security analytics system 118 from the image capture module 714 in the form of various video file formats. Examples of such video file formats familiar to skilled practitioners of the art include Audio Video Interleave (AVI), Windows Media Video (WMV), QuickTime, and various versions of the Motion Pictures Expert Group (MPEG), $3^{rd}$ Generation Partnership Project (3GPP), and Flash video formats.

In certain embodiments, the frequency with which the non-continuous sequence of individual video frames is collected may vary according to whether or not an security incident has been detected. As an example, the targeted application used to acquire images on device camera 628 may be implemented to provide a single video frame per second until a security incident is detected, such as an incidence of visual hacking. However, once detected, the rate at which the individual video frames are provided may then be increased to 30 frames a second. In these embodiments, the method by which the duration of a detected occurrence of visual hacking is determined is a matter of design choice. As an example, the video frame sampling frequency may be preconfigured (e.g., every 2 seconds) and overridden when a security incident is detected.

In certain embodiments, the resolution of the captured images 778 provided to the security analytics service 118 is a matter of design choice. As an example, the captured images 778 may be sent at a low resolution during the performance of certain visual hacking detection operations. However, the resolution of the captured images 778 may be increased once an incidence of visual hacking or other potential security risk has been detected.

In certain embodiments, the image capture feature pack 708 may be implemented to include a risk-adaptive security policy 716. As used herein, a risk-adaptive security policy 716 broadly refers to a security policy implemented to be revised by the security analytics system 118 to adaptively remediate risk associated with certain user behaviors. In certain embodiments, such revisions to the risk-adaptive security policy 716 may be performed by the risk-adaptive protection 120 module. In certain embodiments, revisions to the risk-adaptive security policy 714 may be made in response to the detection of anomalous, abnormal, unexpected or malicious user behavior associated with visual hacking.

In certain embodiments, the risk-adaptive prevention 120 module may be implemented to assess the risk of revising one or more rules, or actions, associated with a risk-adaptive security policy 714. In certain embodiments, the determination of whether the assessed risk is acceptable is a matter of design choice. In certain embodiments, the determination may be made automatically, semi-automatically, or manually. As an example, the risk-adaptive prevention 120 module may be implemented to determine whether the assessed risk is within a particular risk range, or within certain security operational parameters, and if so, automatically decide the assessed risk is acceptable. As another example, the risk-adaptive prevention 120 module may be implemented to notify a security administrator 668 of the assessed risk. In this example, the security administrator 668 may decide whether or not the assessed risk is acceptable.

In certain embodiments, the security analytics system 118 may be implemented to include a user behavior element generator 782 sub-module, a user profile generator 784 sub-module, and an image comparator 786 sub-module. In certain embodiments, the security analytics system 118 may likewise be implemented to include a computer vision machine learning 788 sub-module and a image correlator 790 sub-module. In certain embodiments, the user behavior element generator 782 sub-module may be implemented to process the stream of event data provided by the endpoint agent 306 to generate user behavior elements, described in greater detail herein.

In certain embodiments, the user profile generator 784 sub-module may be implemented to process the stream of event data provided by the endpoint agent 306 and the user behavior elements generated by the user behavior element generator 782 sub-module to generate a user profile, likewise described in greater detail herein. In certain embodiments, the user profile generator 784 sub-module may be implemented to append the user behavior elements generated by the user behavior generator 782 sub-module to an existing user profile. In certain embodiments, the resulting user profiles may be stored in the repository of user profile data 682.

In various embodiments, certain user behavior elements generated by the user behavior element generator 782 sub-module may include captured image data. In certain embodiments, the resulting user behavior elements, or the captured image data they may contain, or a combination thereof, may be stored in a repository of captured image data 784. In certain embodiments, the image comparator 786 sub-module may be implemented to process such user behavior elements to detect incidents of visual hacking. In certain embodiments, the image comparator 786 sub-module may be implemented to perform such detection by comparing user behavior elements containing captured image data to existing captured images stored in the repository of captured image data 784.

In certain embodiments, the image comparator 786 sub-module may be implemented to use various computer vision approaches familiar to skilled practitioners of the art to perform the comparison of user behavior elements containing image data. As used herein, computer vision broadly refers to the interdisciplinary field of using various computing devices to gain a high-level understanding from digital images or videos. In typical implementations, computer vision seeks to replicate how a human processes visual information through automated extraction, analysis and understanding of image data corresponding to individual, or sequences of, digital images. In certain embodiments, such image data may include individual, or sequences of, video frames rendered by a targeted application on an endpoint device, such as a device camera 628, or views from multiple cameras, such as surveillance cameras.

In various embodiments, certain machine learning approaches familiar to those of skill in the art may be implemented to train the computer vision machine learning 788 sub-module to recognize security incidents, such as the occurrence of visual hacking. In certain embodiments, the machine learning approaches may include supervised learning approaches, unsupervised learning approaches, or a combination thereof. As used herein, supervised learning broadly refers to a machine learning approach for inferring a function from labeled training data. The training data typically consists of a set of training examples, with each example consisting of an input object (e.g., a vector) and a desired output value (e.g., a supervisory signal). In certain embodiments, a supervised learning algorithm may be implemented to analyze the training data and produce an inferred function, which in turn can be used for mapping new examples.

As likewise used herein, unsupervised learning broadly refers to a machine learning approach for finding non-obvious or hidden structures within a set of unlabeled data. In certain embodiments, an unsupervised machine learning algorithm is not given a set of training examples. Instead, it attempts to summarize and explain key features of the data it processes. Examples of unsupervised learning approaches include clustering (e.g., k-means, mixture models, hierarchical clustering, etc.) and latent variable models (e.g., expectation-maximization algorithms, method of moments, blind signal separation techniques, etc.).

In various embodiments, certain visual data stored in the repository of captured image data 784, captured image data contained in various user behavior elements, or a combination thereof, may be used to train the computer vision machine learning 788 sub-module. In various embodiments, the repository of captured image data 784 includes a set of ground truth images that may be used to initially train the computer vision machine learning 788 sub-module. In certain embodiments, the computer vision machine learning 788 sub-module may be trained in facial recognition.

Current examples of machine learning approaches that may be used to perform the training of the computer vision machine learning 788 sub-module include Java® OpenImaj®, produced by Oracle, of Redwood Shores, Calif., and Python TensorFlow, provided under open source licensing by the non-profit Python Software Foundation. In certain embodiments, these same approaches may be implemented to classify captured images 778 provided by the image capture module 714. In these embodiments, the method by which the captured images 778 are classified, and the classes used to classify them, is a matter of design choice.

For example, an image of a user, such as user 'A' 602 or 'B' 672 holding a user camera 728 can be detected by the computer vision machine learning 788 sub-module after it has been trained on a folder containing many such images. Likewise, such approaches may be implemented in various embodiments to train the computer vision machine learning 788 sub-module to recognize a user camera 728 being held in a posture indicating that it is being used to capture an image of content being displayed within a UI of an endpoint device 304.

Certain embodiments of the invention reflect an appreciation that captured images 778 provided to the security analytics system 118 by the image capture module 714 should be analyzed as quickly as possible so the display of content within the UI of an endpoint device 304 can be blocked before a user has the opportunity to capture an image of it with a user camera 728. Rapid detection of the use of a user camera 728 within a captured image 628 corresponding to an incidence of visual hacking may be achieved in certain embodiments through the implementation of various deep neural network approaches familiar to skilled practitioners of the art.

An example of such a deep neural network approach includes Inception-V3, which is typically implemented in combination with Python TensorFlow to take certain extracted features in image data and use it as input to a Support Vector Machine (SVM) classifier. Those of skill in the art will be familiar with such approaches, which are typically considered to be a form of transfer learning, in which deep learning is achieved by using a large training dataset for generality while adapting it for recognition of certain features. In certain embodiments, various libraries may be implemented with Python to perform image analysis, including TensorFlow to perform feature extraction via Inception-V3, scikits.learn (SKLearn), and OpenCV, an API to a fast image processing library.

In certain embodiments, the computer vision machine learning 788 sub-module may be implemented in combination with the image correlator 790 sub-module to perform facial recognition operations familiar to skilled practitioners of the art. In certain embodiments, the facial recognition operations may be performed to determine the difference between two users, such as user 'A' 602 and user 'B' 672, whose facial features may have been captured in different sets of captured images 778. In certain embodiments, the results of the facial recognition operations may be used detect the occurrence of a security incidence, such as the occurrence of a visual hacking incident. As an example, user 'A' 602 may be authorized to view certain content displayed within the UI of an endpoint device 304, while user 'B' 672 is not. Accordingly, the performance of facial recognition operations may allow user 'A' 602 to view the content, but prevent user 'B' 672 from doing so.

In various embodiments, certain risk-adaptive protection operations, described in greater detail herein, may be performed by the risk-adaptive prevention 120 module in response to detection of an occurrence of a security incident, such as a visual hacking incident, and adaptively respond to mitigate associated risk. As an example, the security analytics system 118 may be notified if the device camera 628 is disabled or otherwise prevented from providing captured images 778. As a result, the risk-adaptive prevention system 120 may be implemented to prevent the display of sensitive, confidential, or proprietary content within the UI of its associated endpoint device 304. Likewise, the risk-adaptive prevention system 120 may further be implemented to update various rules associated with the risk-adaptive security policy 716 to prevent the display of sensitive, confidential, or proprietary content within the UI of its associated endpoint device 304 until the device camera 628 is operational again. Furthermore, the risk-adaptive prevention system 120 may likewise be implemented to notify a security administrator 668 of the risk-adaptive measures it has enacted.

In certain embodiments, the risk-adaptive protection operations may include detecting when a different user, such as user 'B' 672, is viewing content displayed within the UI of an endpoint device 304 typically associated with another user, such as user 'A' 602. For example, in certain embodiments, a first user behavior element containing a first set of captured image data is compared to a second user behavior element containing a second set of captured image data to determine whether the two users are the same. If not, then a corresponding risk-adaptive response is enacted. In certain embodiments, the comparison between the two sets of captured image data may be performed by the image comparator 786 sub-module. In these embodiments, the method by which it is determined whether the two users are the same is a matter of design choice.

In various embodiments, the risk-adaptive protection operations may include correlating the detection of an occurrence of visual hacking to certain identity resolution information, user behavior information, temporal information, or a combination thereof. In certain embodiments, the correlation may include correlating the content displayed within the UI of an endpoint device 304, one or more captured images 778 associated with the detection of the occurrence of visual hacking, and associated identity resolution, user behavior, and temporal information. In certain embodiments, the image correlator 790 sub-module may be implemented to perform such correlation.

Figure 8:
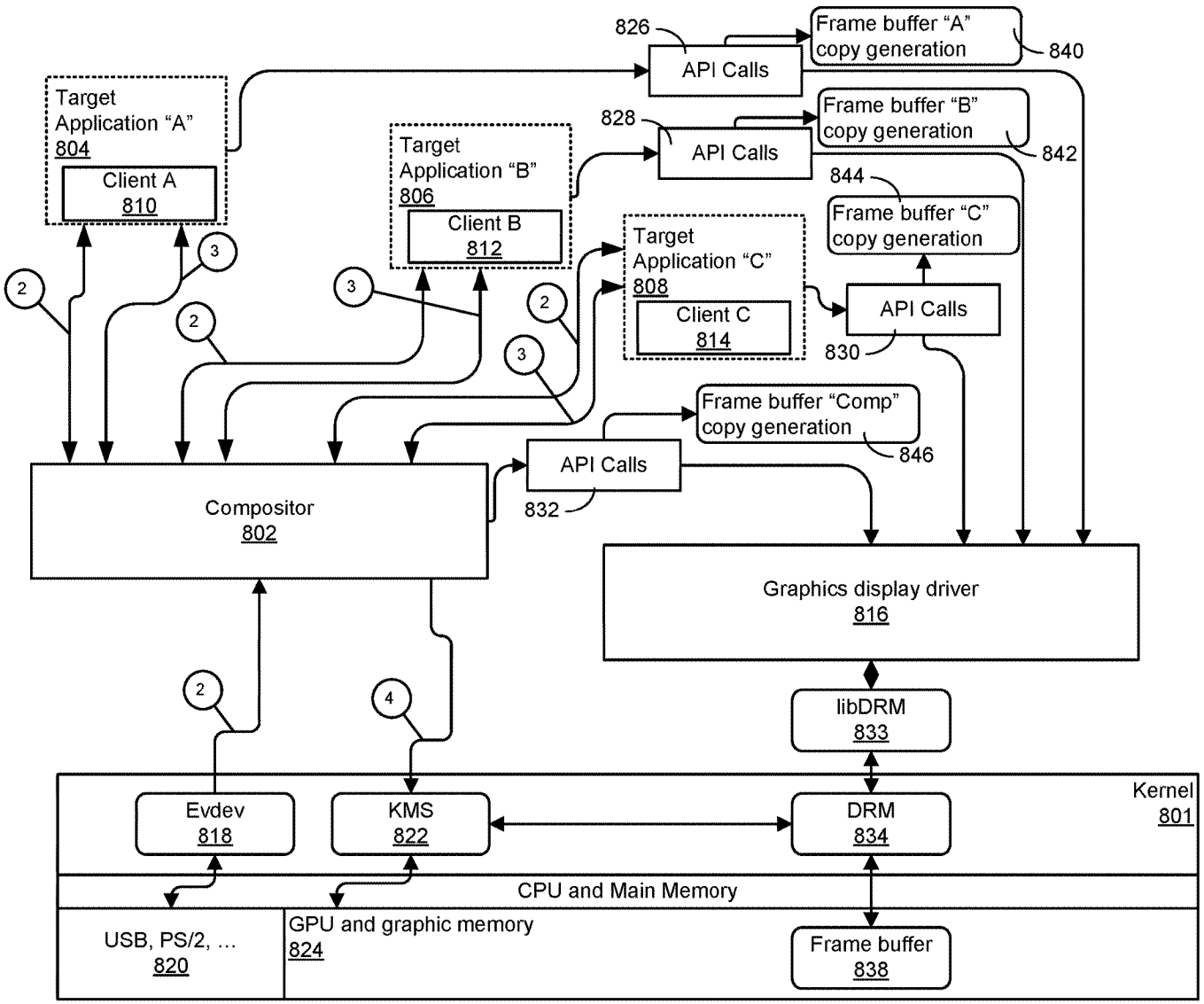
FIG. 8 is a simplified block diagram of an electronic environment in which certain embodiments of the disclosed image capture system may be implemented.

FIG. 8 is a simplified block diagram of an electronic environment in which certain embodiments of the present invention may be implemented. In this example, the electronic environment is shown in the context of a graphics implementation in a Linux system having a Linux kernel 801. Also, for purposes of the following discussion, the electronic environment will be described in the context of a system following the Wayland protocol, which is familiar to those skilled in the art as a graphics system that uses a computer protocol that specifies the communication between a display server and its clients.

In certain embodiments, the Wayland protocol follows a client-server model in which clients are the graphical applications requesting the display of pixel buffers on a display screen, and the server is a service provider controlling the display of these buffers. In the example shown in FIG. 8, a plurality of target applications 804, 806, and 808 render their graphical content using respective clients 810, 812, and 814. In certain embodiments, the clients 810, 812, and 814 communicate with a compositor 802, which implements the server portion of the Wayland display server protocol.

As understood by those skilled in the art, the Wayland reference implementation has been designed as a two-layer protocol. A low-level layer or wire protocol that handles the inter-process communication between the two involved processes—client and compositor—and the marshalling of the data that they interchange. In certain embodiments, this low-level layer is message-based and implemented using the IPC services of kernel 801. Unix domain sockets may be used in certain embodiments employing Linux and Unix-like operating systems. In certain embodiments, the high-level layer handles the information that a client (e.g., clients 810, 812, and 814) and compositor 802 exchange to implement the basic features of a window system.

Certain embodiments of the interaction between the clients 810, 812, and 814 with the compositor 802 can be understood with reference to the communication callouts 1-4. At callout 1, the evdev module 818 of the Linux kernel 801 receives an event from an external event generator 820 and sends the event to the compositor 802. At callout 2, the compositor 802 looks through its scenegraph to determine which window (e.g., which target application client 810, 812, or 814) is to receive the event. As will be understood by those skilled in the art, the scenegraph corresponds to what is on the display screen. The compositor 802 understands the transformations that it may have to apply to the elements in the scenegraph based on the received event. In certain embodiments, the compositor 802 can pick the correct window and transform the screen coordinates for the window to local window coordinates, by applying inverse transformations. In certain embodiments, the types of transformations that can be applied by the compositor 802 to a window is restricted to those for which the compositor 802 can compute the inverse transformation for the input events.

At callout 3, any client 810, 812, or 814 that receives the event updates the graphics (e.g., screen display images) associated with its user interface. In systems using the Wayland protocol, clients 810, 812, and/or 814 render their images to a graphics display driver 816 using EGL API calls based on instructions from the respective target applications 804, 806, and 808.

At callout 4, the compositor 802 collects damage requests from its clients and then re-composites the screen. The compositor can then directly issue an ioctl to schedule a pageflip with KMS 822. As understood by those skilled in the art, Kernel Mode Setting (KMS) is a method for setting display resolution and depth in the kernel space 801 rather than user space. As shown in the example of FIG. 8, KMS 822 provides a communication interface with the GPU and graphic memory 824.

In certain embodiments, the target applications 804, 806, and 808 include respective clients 810, 812, and 814, to render content to the graphics display driver 816 through respective clients 810, 812, 814. In certain embodiments employing the Wayland protocol, the clients 810, 812, and 814 communicate with the graphics display driver 816 using EGL API calls.

In the specific example shown in FIG. 8, target application 804 communicates its graphic content commands through client 810, which, in turn, communicates with graphics display driver 816 using EGL API calls 826. Target application 806 communicates its graphic content commands through client 812, which, in turn, communicates with graphics display driver 816 using EGL API calls 828. Target application 808 communicates its graphic content commands through client 814, which, in turn, communicates with graphics display driver 816 using EGL API calls 830. In certain embodiments, compositor 802 communicates with graphics display driver 816 through EGL API calls 832. Based on the teachings of the present disclosure, it will be recognized those skilled in the art that the graphics rendering API library may include one or more of an EGL library, an OpenVG library, or an OpenGL library. For purposes of the following discussion, without limitation to the overall scope of the present invention, image capturing will be described using the EGL library.

In certain embodiments, the graphics display driver 816 may be implemented using the Mesa computer graphics protocol. As understood by those skilled in the art, Mesa is an open source software implementation of EGL, OpenGL, Vulkan, and other graphics API specifications. In certain embodiments, graphics display driver 816 uses a direct rendering library 833 to communicate with a direct rendering manager 834 in the kernel 801 to communicate video, such as one or more frame buffers 838, to the GPU and graphic memory 824. Additionally, or on the alternative, certain embodiments may use an API called fbdev of kernel 801 to manage the frame buffer 838 of the GPU and graphic memory 824.

Certain embodiments of the disclosed system intercept API calls 826, 828, 830, and 832 calls made by clients 810, 812, 814, and compositor 802 to the graphics display driver 816. In certain embodiments, API calls to the graphics display driver 816 are intercepted to generate copies of frame buffers rendered by target applications 804, 806, 808, and/or compositor 802. In certain embodiments, the copies of the frame buffers are rendered independently of the graphics display driver 816. In the example shown in FIG. 8, API calls 826 made by client 810 for target application 804 (Target Application "A") are intercepted to generate a copy of the frame buffer "A" 840 of target application 804. The copy of the frame buffer "A" 840 is generated using the intercepted API calls 826 and, thus, generated independent of the graphics display driver 816. In certain embodiments, API calls 828 made by client 812 for target application 806 (Target Application "B") are intercepted to generate a copy of the frame buffer "B" 842. The copy of the frame buffer "B" 842 is generated using the intercepted API calls 828 and, thus, generated independent of the graphics display driver 816. In certain embodiments, API calls 830 made by client 814 for target application 808 (Target Application "C") are intercepted to generate a copy of the frame buffer "C" 844. The copy of the frame buffer "C" 844 is generated using the intercepted API calls 830 and, thus, generated independent of the graphics display driver 816. In certain embodiments, API calls 832 made by compositor 802 are intercepted and used to generate a copy of frame buffer "Comp" 846.

Figure 9:
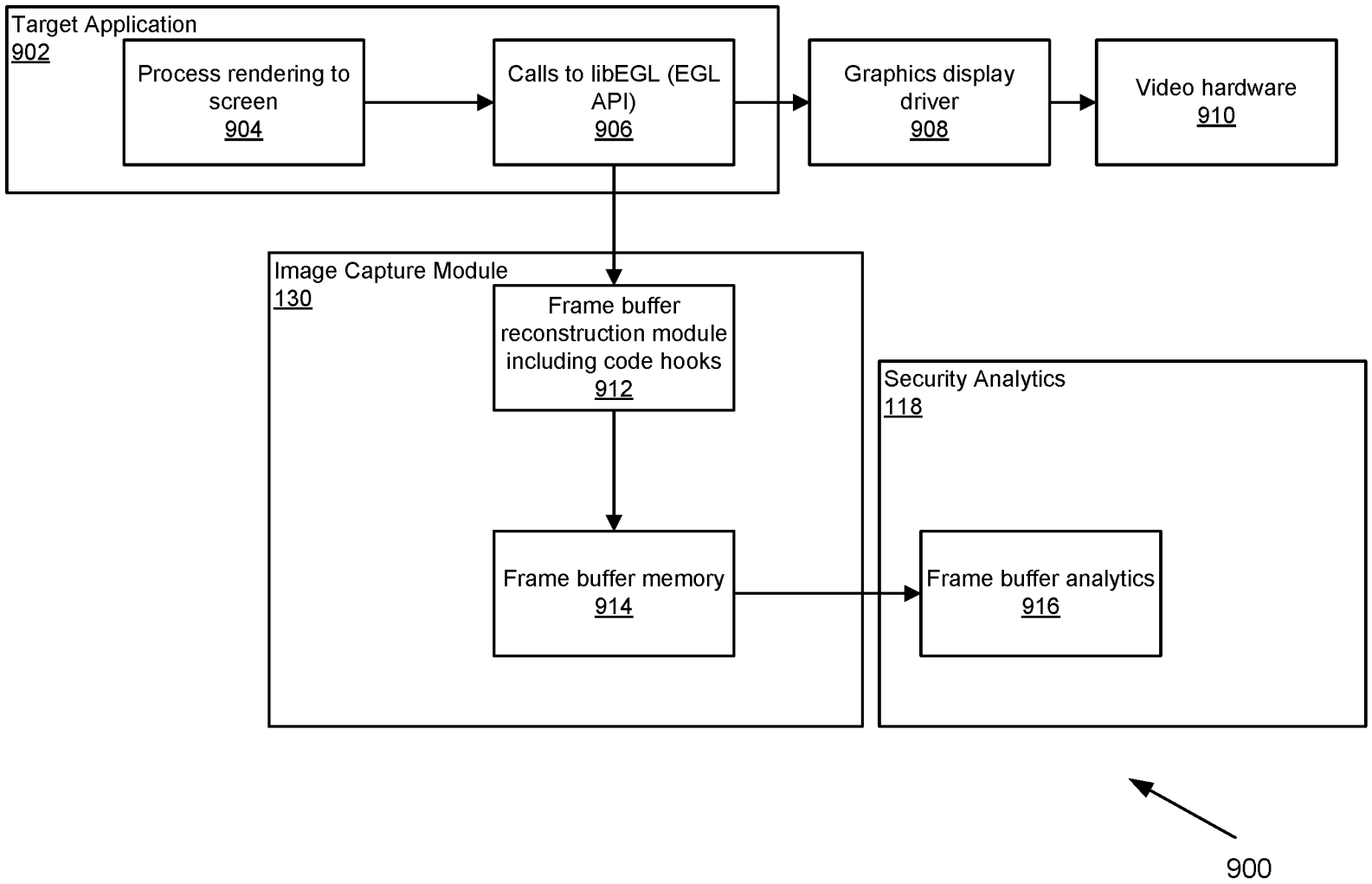
FIG. 9 is a simplified functional block diagram of an electronic environment that may be used to implement certain embodiments of an image capture system.

FIG. 9 illustrates a simplified functional block diagram of an electronic environment 900 that may be used in the implementation of certain embodiments of the present invention. In certain embodiments, the environment 900 includes a target application 902. In certain embodiments, the target application 902 is executed on one or more endpoint devices. In certain embodiments, the target application may include a word processing application, a spreadsheet application, an image editing application, and/or an image acquisition application. In certain embodiments, the target application 902 executes a process rendering to a screen 904, including processes to render images to a display screen. In certain embodiments, the process rendering to the screen 904 generates EGL API calls 906 to graphics display driver 908, which, in turn posts frame buffers constructed from the EGL API calls 906 to video hardware 910. In certain embodiments, the EGL API calls 906 include all graphical image information needed to construct a frame buffer when the frame buffer is posted to the video hardware 910.

The exemplary electronic environment 900 also shows one embodiment of an image capture module 130. In the specific embodiment shown in FIG. 9, the image capture module 130 includes a frame buffer reconstruction module 912 that includes code hooks. In certain embodiments, the code hooks are configured to intercept EGL API calls that are sent to the graphics display driver 908. In certain embodiments, the frame buffer reconstruction module uses the intercepted EGL API calls to reconstruct a copy of the frame buffer that is ultimately posted to the video hardware 910. In certain embodiments, the duplicated frame buffer is copied to frame buffer memory 914 for further use.

In certain embodiments, the duplicated frame buffer is used for security analytics purposes. To this end, the environment 900 may include a security analytics system 118, which may include frame buffer analytics 916 configured to access one or more frame buffers from frame buffer memory. As an example, the process rendering to the screen 904 may be an image acquisition application operating on an endpoint device having a camera. In certain embodiments, the frame buffers acquired by the camera are reconstructed in frame buffer memory 914 may be used by the frame buffer analytics 916 to detect incidents of visual hacking.

In certain embodiments, the frame buffer analytics 916 may be configured to acquire frame buffers reconstructed in response to security analytics triggers. In certain embodiments, such security analytics triggers may include user attempts to access (e.g., retrieve, edit, store, etc.) certain files or types of files. In certain embodiments, such security analytics triggers may include certain user behaviors indicating that the user presents a security risk. In certain embodiments, such security analytic triggers may include an increase in a user risk score or level. Based on the teachings of the present disclosure, it will be recognized that other security triggers may also be used to initiate an analysis of copied frame buffers.

Figure 10:
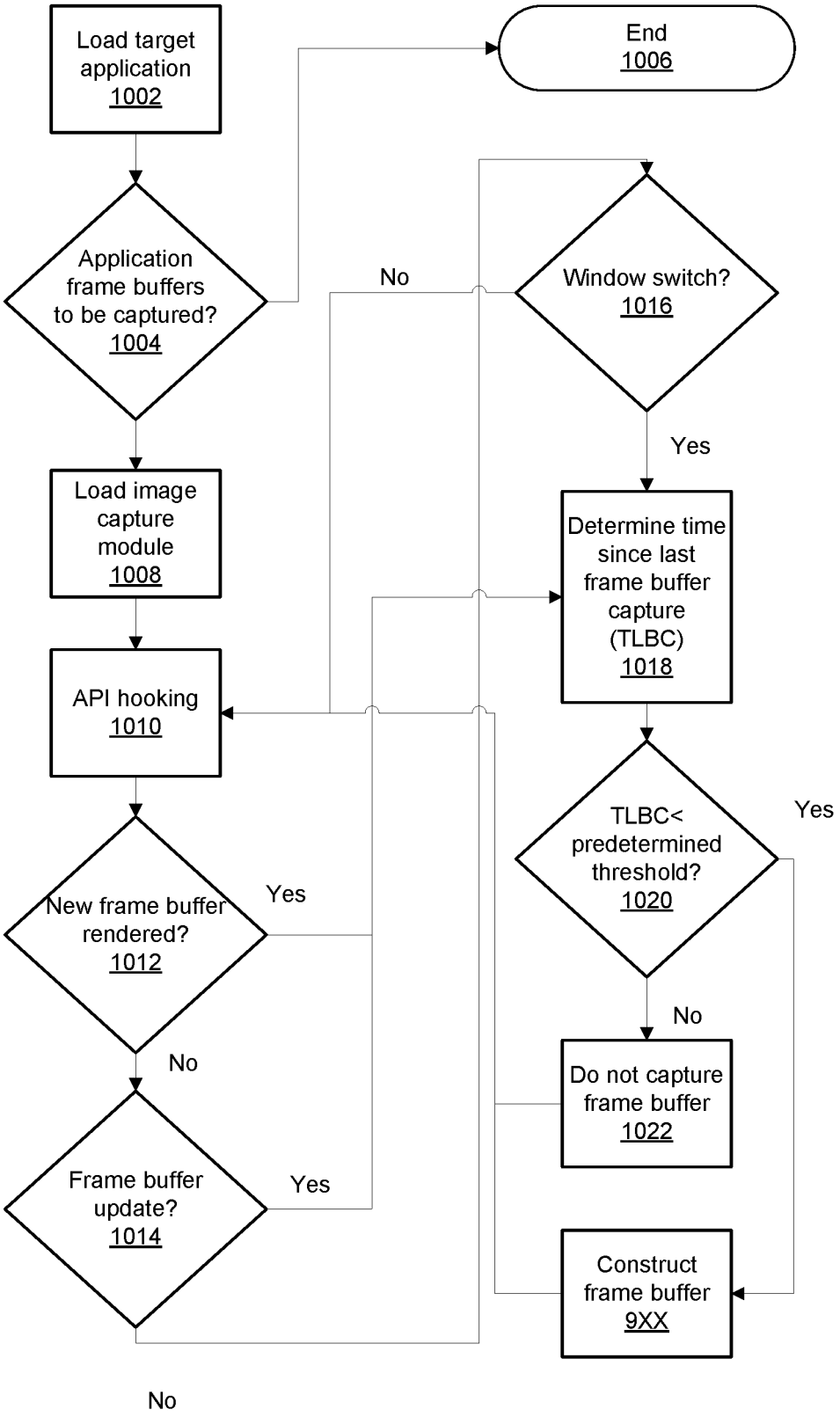
FIG. 10 is a flowchart showing exemplary operations that may be executed to capture an image rendered by a target application.

FIG. 10 is a flowchart showing exemplary operations that may be executed to capture an image rendered by a target application. In certain embodiments, a target application is loaded at operation 1002. In certain embodiments, as a matter of design choice, it may be desirable to only capture frame buffers rendered by certain types of applications. As an example, a check may be made at operation 1004 as to whether the application loaded at operation 1002 is the type of application for which frame buffers are to be captured. In certain embodiments, if frame buffers are not to be captured from the application, further frame buffer capturing operations are not needed and any frame buffer capture processes are halted at operation 1006.

If frame buffers are to be captured from the target application, an image capture module is loaded at operation 1008. In some embodiments, the image capture module is loaded concurrently with the target application at operation 1002. In certain embodiments, the image capture module may be loaded during runtime of the target application. In certain embodiments, the image capture module may be partially loaded with the target application at operation 1002, with the remainder of the image capture module being loaded during runtime of the target application.

In certain embodiments, the image capture module includes software hooks that intercept EGL API calls at operation 1010. As used herein, the term hooking covers a range of techniques used to alter or augment the behavior of an operating system, of applications, or of other software components by intercepting function calls or messages or events passed between software components. Code that handles such intercepted function calls (e.g., EGL API calls), events or messages is called a hook.

Hooking may be achieved in a number of different manners. Certain embodiments may employ run jump hooks. In certain embodiments, using a run-jump hook involves identifying the beginning of an API function that is to be hooked. In certain embodiments, the code at the beginning of the API function is replaced with a jump to a function in the image capture module. Once the function in the image capture module is completed, operation returns to execution of the original API function code.

In certain embodiments, In certain embodiments in which the hooks are inserted at load time of the target application, a technique known as "source modification" may be employed. In certain embodiments, source modification may be implemented by modifying the source of the executable or library before the target application is running to intercept API function calls and either monitor them or replace them entirely. In certain embodiments, the entry point of an API function can be found and then altered to instead dynamically load some other library module to execute desired methods within that loaded library. In certain embodiments, another approach by which hooking can be achieved is by altering the import table of an executable. In certain embodiments, the import table can be modified to load any additional library modules as well as changing what external code is invoked when an API function is called by the application.

In certain embodiments, operating systems and software may provide the means to insert API hooks for the image capture module at runtime. In certain embodiments, the image capture module is granted permission to intercept the API calls, in which case the hooks may be readily inserted after the target application has been loaded.

In certain embodiments, hooking may be implemented by intercepting function calls through a wrapper library. As an example, when creating a wrapper, an alternative version of a library is loaded with the target application. The alternative version of the library may include all the same functionality of the original library that it replaces. In such embodiments, substantially all the functions are the same between the original and the replacement library. In certain embodiments, the wrapper library can be configured to call any of the functionality from the original library, or replace it with an entirely new set of logic.

Certain embodiments of the image capture module may implement DLL injection. As used herein, DLL injection is a technique used for running code within the address space of another process by forcing it to load a dynamic-link library. In certain embodiments, DLL injection may be used by the image capture module to influence the behavior of the target application without permissions. In certain embodiments, the injected code could be used to provide hooks to intercept the EGL API function calls.

In certain embodiments, EGL API calls are hooked at operation 1010. In certain embodiments, a frame buffer is constructed from the EGL API calls in response to every EGL API call made from the target application to the graphics display driver. In certain embodiments, a frame buffer is only constructed in response to frame buffer changes. In certain embodiments, a new frame buffer is only constructed by the image capture module if a predetermined period of time has elapsed since the construction of the previous frame buffer. Operations in which such frame buffer construction determinations may be made are exemplified, without limitation to the overall scope of the present invention, in FIG. 10.

In certain embodiments, whether the image capture system captures a frame buffer may be dependent on the type of EGL API hooked at operation 1010. In certain embodiments, a determination may be made at operation 1012 as to whether the hooked API calls are made to render a new frame buffer to the graphics display driver. In certain embodiments, a determination may be made at operation 1014 as to whether the hooked API calls are made to update an existing frame buffer. In certain embodiments, a determination may be made at operation 1016 as to whether the hooked API calls correspond to a window switch. It will be recognized, in view of the teachings of the present disclosure, that various criterion based on the type of EGL API call may be used to determine whether a frame buffer is to be captured.

If the hooked EGL API calls meet one or more of the criterion at operations 1012, 1014, and/or 1016, certain embodiments may use the time that has elapsed since the last frame buffer was captured to reduce the number of frame buffers captured within a specified period of time. Certain embodiments may thus reduce the resources needed by the image capture module. However, it will be recognized by those skilled in the art, in view of the teachings of the present disclosure, that such time limitation criterion need not be employed before capturing a frame buffer.

Certain embodiments employing time limitation criterion for capturing a frame buffer may determine the elapsed time since the last frame buffer capture (TLBC) at operation 1018. In certain embodiments, the TLBC is compared to a predetermined threshold value at operation 1020. In certain embodiments, if the TLBC is less than the predetermined threshold value, a decision that it is too soon to construct another frame buffer is made at operation 1022, and EGL API calls continue to be intercepted at operation 1010 without capturing the frame buffer. In certain embodiments, if the TLBC is greater than the predetermined threshold value, a new frame buffer is constructed using the intercepted EGL API calls and stored at operation 1024, and EGL API calls continue to be intercepted at operation 1010.

Figure 11:
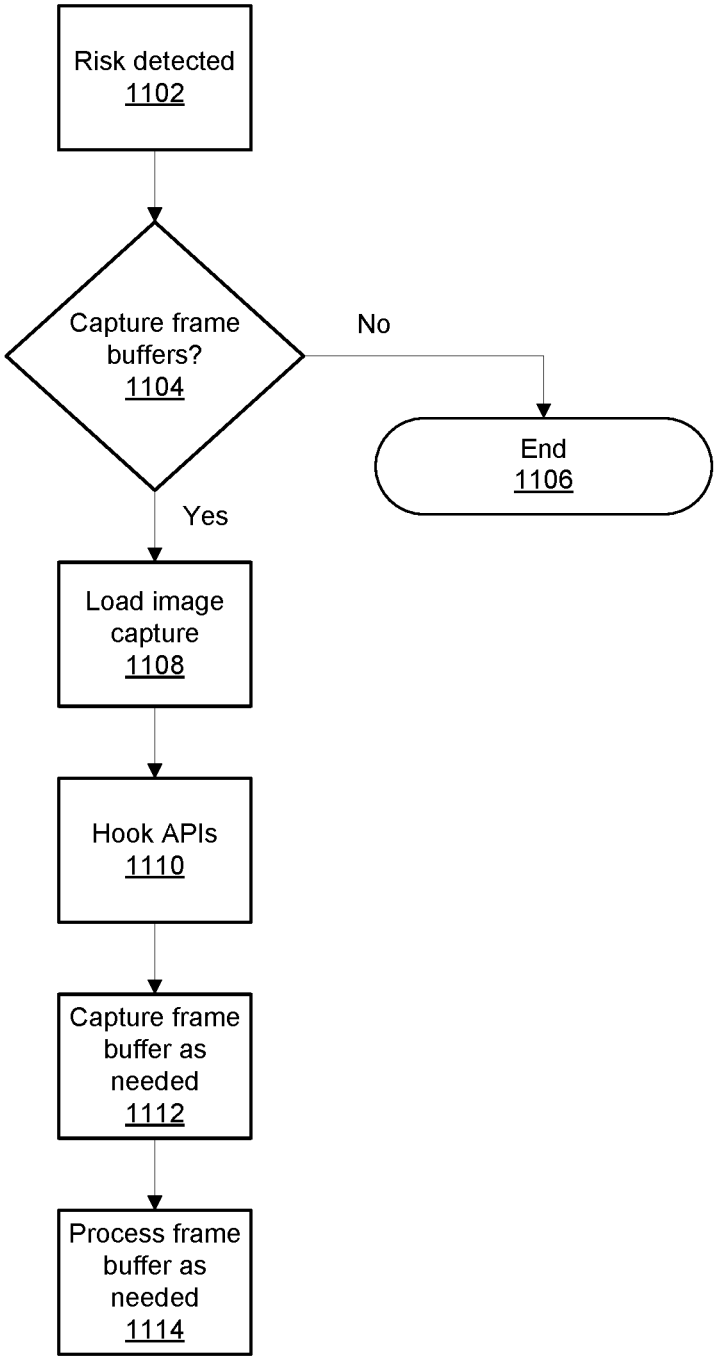
FIG. 11 is a flowchart depicting exemplary operations that may be used to implement a security system having image capture capabilities.

FIG. 11 is a flowchart depicting exemplary operations that may be used to implement a security system having image capture capabilities. In certain embodiments, a security risk is detected by the security analytics system at operation 1102. In certain embodiments, the security analytics system determines at operation 1104 whether the detected security risk warrants capturing frame buffers. As an example, a change in a user's risk behavior may have resulted in an increased security risk score and/or risk level for the user. For example, the determination as to whether frame buffers are to be captured from a target application operated by the user may be based on the value of the security risk score, the security risk level, a change in the value of the security risk score, a change in the security risk level, etc. In certain embodiments, one or more such security risk criterion may be used in the determination at operation 1104. If the security risk detected at operation 1102 does not warrant capturing frame buffers from a target application operated by the user, the process may end at operation 1106. Otherwise, the image capture module may be loaded at operation 1108.

In certain embodiments, EGL API calls from the target application to the graphics display driver are hooked at operation 1110. Certain embodiments capture the frame buffer as needed at operation 1112. As noted with respect to the flowchart shown in FIG. 10, various criterion may be used to determine whether a frame buffer is to be captured at operation 1112. At operation 1114, certain embodiments process the frame buffer as needed. As an example, certain embodiments may process the frame buffer at operation 1114 to detect visual hacking.

As will be appreciated by one skilled in the art, the present invention may be embodied as a method, system, or computer program product. Accordingly, embodiments of the invention may be implemented entirely in hardware, entirely in software (including firmware, resident software, microcode, etc.) or in an embodiment combining software and hardware. These various embodiments may all generally be referred to herein as a "circuit," "module," or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example, but not limited to, an electronic, magnetic, optical, electromagnetic, infrared, or semiconductor system, apparatus, or device. More specific examples (a non-exhaustive list) of the computer-readable medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, or a magnetic storage device. In the context of this document, a computer-usable or computer-readable medium may be any medium that can contain, store, communicate, or transport the program for use by or in connection with the instruction execution system, apparatus, or device.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

Embodiments of the invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While particular embodiments of the present invention have been shown and described, it will be obvious to those skilled in the art that, based upon the teachings herein, changes and modifications may be made without departing from this invention and its broader aspects. Therefore, the appended claims are to encompass within their scope all such changes and modifications as are within the true spirit and scope of this invention. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more"

or "at least one" and indefinite articles such as "a" or "an"; the same holds true for the use in the claims of definite articles.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

Consequently, the invention is intended to be limited only by the spirit and scope of the appended claims, giving full cognizance to equivalents in all respects.

What is claimed is:

1. A computer-implemented method comprising:

providing an endpoint device with an endpoint agent to establish a protected endpoint, the endpoint agent comprising an image capture module and a risk-adaptive security policy;

acquiring an image using an image acquisition device at the endpoint device;

using a target application executing at the endpoint device to provide API calls to a graphics display driver to render the image acquired by the image acquisition device;

intercepting the API calls made by the target application to the graphics display driver, wherein the API calls are intercepted by the image capture module of the endpoint agent, wherein the API calls made to the graphics display driver by the target application are made using a graphics rendering API library;

using the API calls intercepted by the image capture module to construct a copy of a frame buffer of the image, wherein the copy of the frame buffer is constructed by the image capture module independent of the graphics display driver;

using the copy of the frame buffer of the image to detect an occurrence of a visual hacking incident, wherein the visual hacking incident includes visually collecting confidential information at the endpoint device using the image acquired by the image acquisition device; and performing a risk-adaptive security operation, the risk-adaptive security operation adaptively responding to mitigate a risk associated with the visual hacking incident based on the risk-adaptive security policy.

2. The computer-implemented method of claim 1, wherein the intercepted API calls are obtained using software hooks inserted during runtime of the target application; and, the software hooks allow the endpoint agent to subscribe to other events occurring at the endpoint device.

3. The computer-implemented method of claim 1, wherein the intercepted API calls comprise one or more of:

API calls instantiating a frame buffer;

API calls updating a frame buffer; and

API calls swapping a window.

4. The computer-implemented method of claim 1, wherein the graphics rendering API library includes one or more of an EGL library, an OpenVG library, or an OpenGL library.

5. The computer-implemented method of claim 1, wherein the target application comprises one or more of:

a word processing application;

a spreadsheet application;

an image editing application;

a web browser application;

a desktop environment application; and an image acquisition application.

6. The computer-implemented method of claim 1, further comprising:

storing the copied frame buffer in memory, wherein the memory is accessible by a security analytics system; and analyzing the copied frame buffer by the security analytics system to detect potential violations of a security policy.

7. The computer-implemented method of claim 6, wherein analysis of the copied frame buffer to detect potential violations of the security policy by the security analytics system is initiated in response to one or more of:

access of one or more predetermined images for display by the target application;

acquisition of an image by the image acquisition device at the endpoint device for display by the target application;

access of one or more predetermined files for display by the target application; and access of one or more predetermined file types for display by the target application.

8. A system comprising:

a processor;

a data bus coupled to the processor; and a non-transitory, computer-readable storage medium embodying computer program code, the non-transitory, computer-readable storage medium being coupled to the data bus, the computer program code interacting with a plurality of computer operations and comprising instructions executable by the processor and configured for:

providing an endpoint device with an endpoint agent to establish a protected endpoint, the endpoint agent comprising an image capture module and a risk-adaptive security policy;

acquiring an image using an image acquisition device at the endpoint device;

using a target application executing at the endpoint device to provide API calls to a graphics display driver to render the image acquired by the image acquisition device;

intercepting the API calls made by the target application to the graphics display driver, wherein the API calls are intercepted by the image capture module of the endpoint agent, wherein the API calls made to the graphics display driver by the target application are made using a graphics rendering API library;

using the API calls intercepted by the image capture module to construct a copy of a frame buffer of an image, wherein the copy of the frame buffer is constructed by the image capture module independent of the graphics display driver;

using the copy of the frame buffer of the image to detect an occurrence of a visual hacking incident, wherein the visual hacking incident includes visually collecting confidential information at the endpoint device using the image acquired by the image acquisition device; and, performing a risk-adaptive security operation, the risk-adaptive security operation adaptively responding to mitigate a risk associated with the visual hacking incident based on the risk-adaptive security policy.

9. The system of claim 8, wherein the intercepted API calls are obtained using software hooks inserted during runtime of the target application; and, the software hooks allow the endpoint agent to subscribe to other events occurring at the endpoint device.

10. The system of claim 8, wherein the intercepted API calls comprise one or more of:

API calls instantiating a frame buffer;

API calls updating a frame buffer; and

API calls swapping a window.

11. The system of claim 8, wherein the graphics rendering API library includes one or more of an EGL library, an OpenVG library, or an OpenGL library.

12. The system of claim 8, wherein the target application comprises one or more of:

a word processing application;

a spreadsheet application;

an image editing application;

a web browser application;

a desktop environment application; and an image acquisition application.

13. The system of claim 8, wherein the instructions are further configured for:

storing the copied frame buffer in memory, wherein the memory is accessible by a security analytics system; and analyzing the copied frame buffer by the security analytics system to detect potential violations of a security policy.

14. The system of claim 13, wherein analysis of the copied frame buffer to detect potential violations of the security policy by the security analytics system is initiated in response to one or more of:

access of one or more predetermined images for display by the target application;

acquisition of an image by the image acquisition device for display by the target application;

access of one or more predetermined files for display by the target application; and access of one or more predetermined file types for display by the target application.

15. A non-transitory, computer-readable storage medium embodying computer program code, the computer program code comprising computer executable instructions configured for:

providing an endpoint device with an endpoint agent to establish a protected endpoint, the endpoint agent comprising an image capture module and a risk-adaptive security policy;

acquiring an image using an image acquisition device at the endpoint device;

using a target application executing at the endpoint device to provide API calls to a graphics display driver to render the image acquired by the image acquisition device;

intercepting the API calls made by the target application to the graphics display driver, wherein the API calls are intercepted by the image capture module of the endpoint agent, wherein the API calls made to the graphics display driver by the target application are made using a graphics rendering API library;

using the API calls intercepted by the image capture module to construct a copy of a frame buffer of an image, wherein the copy of the frame buffer is constructed by the image capture module independent of the graphics display driver;

using the copy of the frame buffer of the image to detect an occurrence of a visual hacking incident, wherein the visual hacking incident includes visually collecting confidential information at the endpoint device using the image acquired by the image acquisition device; and, performing a risk-adaptive security operation, the risk-adaptive security operation adaptively responding to mitigate a risk associated with the visual hacking incident based on the risk-adaptive security policy.

16. The non-transitory, computer-readable storage medium of claim 15, wherein the intercepted API calls are obtained using software hooks inserted during runtime of the target application; and, the software hooks allow the endpoint agent to subscribe to other events occurring at the endpoint device.

17. The non-transitory, computer-readable storage medium of claim 15, wherein the intercepted API calls comprise one or more of:

API calls instantiating a frame buffer;

API calls updating a frame buffer; and

API calls swapping a window.

18. The non-transitory, computer-readable storage medium of claim 15, wherein the graphics rendering API library includes one or more of an EGL library, an OpenVG library, or an OpenGL library.

19. The non-transitory, computer-readable storage medium of claim 15, wherein the instructions are further configured for:

storing the copied frame buffer in memory, wherein the memory is accessible by a security analytics system; and analyzing the copied frame buffer by the security analytics system to detect potential violations of a security policy.

20. The non-transitory, computer-readable storage medium of claim 19, wherein analysis of the copied frame buffer to detect potential violations of the security policy by the security analytics system is initiated in response to one or more of:

access of one or more predetermined images for display by the target application;

acquisition of an image by the image acquisition device for display by the target application;

access of one or more predetermined files for display by the target application; and access of one or more predetermined file types for display by the target application.

* * * * *